US005935383A

United States Patent [19]

Sun et al.

[11] Patent Number: 5,935,383

[45] Date of Patent: Aug. 10, 1999

[54] METHOD FOR IMPROVED WET STRENGTH PAPER

[75] Inventors: Tong Sun, Neenah; Jeffrey Dean Lindsay, Appleton, both of Wis.

[73] Assignee: Kimberly-Clark Worldwide, Inc., Neenah, Wis.

[21] Appl. No.: 09/036,106

[22] Filed: Mar. 6, 1998

Related U.S. Application Data

[63] Continuation-in-part of application No. 08/760,331, Dec. 4, 1996.

[51] Int. Cl.[6] ..... D21H 21/20

[52] U.S. Cl. ..... 162/158; 162/146; 162/157.6; 162/182; 162/183; 162/9

[58] Field of Search ..... 162/9, 158, 157.6, 162/146, 182, 111, 109, 112, 183

[56] References Cited

U.S. PATENT DOCUMENTS

| | | | |
|---|---|---|---|
| 2,345,543 | 3/1944 | Wohnsiedler et al. | 260/72 |
| 2,926,116 | 2/1960 | Keim | 162/164 |
| 2,926,154 | 2/1960 | Keim | 260/29.2 |
| 3,016,325 | 1/1962 | Pattilloch | 162/164 |
| 3,448,005 | 6/1969 | Allison, Jr. et al. | 162/164 |
| 3,481,682 | 12/1969 | Machell | 3/1 |
| 3,533,725 | 10/1970 | Bridgeford | 8/115.6 |
| 3,556,932 | 1/1971 | Coscia et al. | 162/166 |
| 3,556,933 | 1/1971 | Williams et al. | 162/167 |
| 3,576,712 | 4/1971 | Hine, Jr. et al. | 162/168 |
| 3,700,623 | 10/1972 | Keim | 260/80.3 R |
| 3,734,685 | 5/1973 | Perrier et al. | 8/129 |
| 3,772,076 | 11/1973 | Keim | 117/155 R |
| 3,817,702 | 6/1974 | Paulus et al. | 8/120 |
| 3,855,158 | 12/1974 | Petrovich et al. | 260/2 BP |
| 3,899,388 | 8/1975 | Petrovich et al. | 162/164 |
| 3,902,958 | 9/1975 | Breen et al. | 162/164 |
| 3,951,588 | 4/1976 | Perrin et al. | 8/1 A |
| 3,969,116 | 7/1976 | Shiba et al. | 96/27 E |
| 4,007,164 | 2/1977 | Bien et al. | 260/146 D |
| 4,092,308 | 5/1978 | Hegar | 260/153 |
| 4,129,528 | 12/1978 | Petrovich et al. | 260/823 |
| 4,134,724 | 1/1979 | Thompson et al. | 8/54.2 |
| 4,140,852 | 2/1979 | Eckstein et al. | 542/456 |
| 4,141,890 | 2/1979 | Hegar et al. | 260/153 |
| 4,147,586 | 4/1979 | Petrovich et al. | 162/135 |
| 4,155,707 | 5/1979 | Franceschini et al. | 8/2.5 R |
| 4,222,921 | 9/1980 | Van Eenam | 260/296.6 H |

(List continued on next page.)

FOREIGN PATENT DOCUMENTS

| | | |
|---|---|---|
| 0 685 593 A3 | 12/1995 | European Pat. Off. . |
| 1 512 076 | 5/1978 | United Kingdom . |

OTHER PUBLICATIONS

Allan, G.G. and W.M. Reif, "Fiber Surface Modification: The Stereotopochemistry of Ionic Bonding in Paper," *Svensk Papperstidning,* arg. 74, Nr. 18, Sep. 30, 1971, pp. 563–570.

Bourgoing, Steve and Sylvain Robert, "Use of Fluorescent Whitening Agents Against Light–Induced Colour Reversion of High Yield Pulps," Centre de Recherche en Pates et Papiers, University de Quebec a Trois–Rivieres, pp. 1–4.

"Reactive Dyes," *Colour Index,* Third Edition, The Society of Dyers and Colourists, vol. 3, 1971, pp. 3391–3392.

*Colour Index,* Third Edition, The Society of Dyers and Colourists, vol. 4, 1971, p. 4371.

"Reactive Dyes," *Colour Index,* Revised Third Edition, The Society of Dyers and Colourists, vol. 6, 1975, p. 6265.

Course, B.W. et al., "Fluorescent Whitening Agents in the Paper Industry: Their Chemistry and Measurement," *Tappi Journal,* vol. 64, No. 7, Jul. 1981, pp. 87–89.

Hebeish, A. et al., "Graft Copolymerization of Vinyl Monomers on Modified Cottons," *Cellulose Chemistry and Technology,* 15, 1981, pp. 505–521.

Heitner, Cyril, "Chemistry of Brightness Reversion and its Control," *Pulp Bleaching: Principles and Practice,* Section III, Chapter 5, Edited by Dence and Reeve, Tappi Press, Atlanta, Georgia, 1996, pp. 185–211.

"Dyes, Reactive," *Kirk–Othmer Encyclopedia of Chemical Technology,* Third Edition, vol. 8, 1985, pp. 374–392.

"Fluorescent Whitening Agents," *Kirk–Othmer Encyclopedia of Chemical Technology,* Fourth Edition, vol. 11, 1994, pp. 227–241.

Libnarova, Milena, "Hernostan B Under Operating Conditions," *Papir a Celuloza,* vol. 36, No. 10, 1981, pp. 215–217.

"Dyeing With Reactive Dyes," *Cellulosics Dyeing,* edited by John Shore, Society of Dyers and Colourists, 1995, pp. 189–215.

Zhang, Liming and Goran Gellerstedt, "Reactive Structures in Wood and High–Yield Pulps. IV. Daylight–Induced oxidation of Stilbene Structures in the Solid State," *Acta Chemica Scandinavica,* 48, 1994, pp. 490–497.

*Primary Examiner*—Stanley S. Silverman
*Assistant Examiner*—José A. Fortuna
*Attorney, Agent, or Firm*—Gregory E. Croft

[57] ABSTRACT

The invention is a method for improving the efficiency of aqueous cationic wet strength additives by pretreating cellulose surfaces with reactive anionic compounds, thus providing the cellulose surface with additional anionic sites suitable for retaining a high proportion of said cationic wet strength additives on the cellulose. The wet strength additives on the cellulose surface are cured or reacted with the cellulose surface. The resulting fibrous material has unusually high wet strength with unusually low doses of cationic wet strength additive. The preferred reactive anionic compounds comprise compounds having a reactive group suitable for covalent bonding to hydroxyl groups on cellulose, and further having sulfonic or other anionic end groups capable of attracting cationic wet strength compounds in aqueous solution. The invention also includes means of preventing photoyellowing of high-yield fibers while simultaneously improving wet strength performance.

76 Claims, 5 Drawing Sheets

U.S. PATENT DOCUMENTS

| | | | |
|---|---|---|---|
| 4,228,071 | 10/1980 | Riat et al. | 260/153 |
| 4,240,935 | 12/1980 | Dumas | 260/9 |
| 4,347,100 | 8/1982 | Brucato | 162/10 |
| 4,402,703 | 9/1983 | Panto et al. | 8/541 |
| 4,426,441 | 1/1984 | Adin et al. | 430/351 |
| 4,501,641 | 2/1985 | Hirakawa et al. | 162/164.3 |
| 4,536,598 | 8/1985 | Klijanowicz et al. | 564/49 |
| 4,563,189 | 1/1986 | Lewis | 8/493 |
| 4,603,176 | 7/1986 | Bjorkquist et al. | 525/329.4 |
| 4,605,702 | 8/1986 | Guerro et al. | 525/154 |
| 4,678,473 | 7/1987 | Vigo et al. | 8/480 |
| 4,732,845 | 3/1988 | Keiji et al. | 430/551 |
| 4,911,700 | 3/1990 | Makoui et al. | 604/376 |
| 5,032,226 | 7/1991 | Winiker | 162/158 |
| 5,063,131 | 11/1991 | Abe et al. | 430/372 |
| 5,173,397 | 12/1992 | Noda et al. | 430/531 |
| 5,201,998 | 4/1993 | Topfl et al. | 162/158 |
| 5,213,888 | 5/1993 | Kubbota et al. | 428/328 |
| 5,225,047 | 7/1993 | Graef et al. | 162/9 |
| 5,231,062 | 7/1993 | Mathers et al. | 501/96 |
| 5,296,325 | 3/1994 | Ohtsuka et al. | 430/106 |
| 5,300,194 | 4/1994 | Welkener et al. | 162/199 |
| 5,342,916 | 8/1994 | Weiser et al. | 528/150 |
| 5,399,240 | 3/1995 | Graef et al. | 162/9 |
| 5,432,266 | 7/1995 | Herd et al. | 534/642 |
| 5,466,337 | 11/1995 | Darlington et al. | 162/164.3 |
| 5,494,554 | 2/1996 | Edwards et al. | 162/111 |
| 5,522,967 | 6/1996 | Shet | 162/9 |
| 5,538,596 | 7/1996 | Satterfield et al. | 162/164.5 |
| 5,556,510 | 9/1996 | Dreisbach et al. | 162/158 |
| 5,656,132 | 8/1997 | Farrington, Jr. et al. | 162/117 |
| 5,672,248 | 9/1997 | Wendt et al. | 162/109 |

METHOD FOR IMPROVED WET STRENGTH PAPER

This application is a continuation-in-part of U.S. Ser. No. 08/760,331 filed Dec. 4, 1996.

BACKGROUND OF THE INVENTION

In the art of papermaking, chemical materials exist for improving the strength of paper when wetted with water or aqueous solutions, including body fluids such as urine, blood, mucus, menses, lymph and other body exudates. These materials are known in the art as "wet strength agents" and are commercially available from a wide variety of sources.

The substantivity or effectiveness of many cationic wet strength agents is limited by low retention of the wet strength agent on the cellulose fiber. Much of the applied chemical may not be retained on the fiber, but remains in solution or is washed off after application, for there are relatively few anionic sites on the cellulose surface to attract the charged wet strength agent, and in some cases there may be a large number of anionic sites on colloidal particles or other particles in the fiber suspension which may adsorb a large portion of the wet strength agent, limiting its effectiveness in increasing wet strength. Likewise, the presence of anionic additives or agents in the pulp has a deleterious effect on the efficiency of cationic wet strength agents. This adverse effect can be reduced by adding "cationic promoters" or other cationic additives to the stock, as is known in the art of papermaking, to help neutralize excess anionic sites on colloidal particles or "anionic trash" in the suspension, to allow more of a subsequently added cationic wet strength resin to attach to the fiber surface and not to be preferentially absorbed onto non-fiber components. Such additives can, for example, be cationic promoters such as polyethyleneimine with a cationic charge of about 0.75 to 3.5 milliequivalents/gram, quaternized polyamines, such as polydiallyidimethylammonium chloride, or cationic starch. Commonly used cationic resins include polyquaternary amines and are available from Cytec Industries under the trade names CYPRO 514, 515, 516. Cationic promoters are added to the stock in advance of the wet strength resins to ensure adequate mixing and adequate contact with the fibers. When used, the cationic resins are generally used in an amount of about 1 to 10 pounds per ton or 0.05 to 0.5%. The cationic promoter can be used at 0 to 0.5 wt %; typically the resins are used in an amount of about 0.02 to 0.3 wt % and preferably 0.1 to 0.2 wt %. The manufacturer of the promoter will typically recommend a pH for its use. The Cypro resins, for example, are effective over a pH of about 4 to 9.

However, the use of cationic promoters does not increase the number of anionic sites on the fiber surface itself, and may decrease the number of such sites, such that the intrinsic potential of the cationic wet strength agent to increase wet strength is still limited by inadequate attachment sites on the cellulose surface. What is needed, therefore, is an improved means of increasing the wet strength performance of paper prepared with cationic wet strength agents through the addition of anionic sites on the cellulose fiber. (The extent of anionic sites on the cellulose can be measured in terms of the carboxyl group content of cellulose, which is typically measured to be about 2 to 5 milliequivalent per 100 grams of cellulose, or higher.)

While the use of fiber reactive agents to enhance the efficiency of wet strength agents is not known, fiber reactive agents are known in the art, particularly for treatment of textiles. In particular, anionic fiber reactive dyes are well known in the art. By reactive dyes are meant the customary dyes that form a covalent bond with cellulose, e.g. those listed under the heading "Reactive dyes" in the Colour Index, Vol. 3, 3rd Edition (1971), on pages 3391–3560, and in Vol. 6, revised 3rd Edition (1975), on pages 6268–6345. Fiber reactive dyes contain functional groups with react with the hydroxyl groups of cellulose to form covalent bonds, and further contain anionic groups such as sulfonic groups. Monochlorotriazinyl reactive dyes are one exemplary class. Other fiber-reactive groups may be, for example monofluorotriazinyl, dichlorotriazinyl, dichloroquinoxalinyl, trichloropyrimidyl, difluorochloropyrimidyl, the α-bromoacrylamide group or the β-oxyethylsulphuric acid ester group, as disclosed in U.S. Pat. No. 4,155,707 issued to Franceschini et al., May 22, 1979, herein incorporated by reference. Many commercial dyes are stilbene derivatives and particularly are derivatives of 4,4'-diaminostilbene-2,2'-disulfonic acid, sometimes known as flavonic acid. Other fiber reactive dyes of importance are disclosed in U.S. Pat. No. 5,432,266 issued Jul. 11, 1995 to Herd and Roschger; U.S. Pat. No. 4,402,703 issued Sep. 6, 1983 to Panto and Kaswell; all of which are herein incorporated by reference.

In addition to fiber reactive dyes, fiber reactive fluorescent whitening agents and optical brighteners are known which employ reactive groups such as the chloro- or fluoro-s-triazinyl radical or a 5-chloro-2,6-difluoro-4-pyrimidinyl or 5-chloro-6-fluoro-4-pyrimidinyl radical; and other moieties known in the art of fiber reactive dyes, coupled with UV absorbing structures such as stilbene derivatives. Fluorescent whitening agents do not absorb light strongly in the visible spectrum, being substantially colorless in visible light, but do absorb ultraviolet light (e.g., in the wavelength range of about 300 to about 400 nm) and re-emit the energy absorbed as visible light, typically blue, thus increasing the apparent brightness of the material and helping to overcome a possibly yellow appearance. If excessive doses of fluorescent whitening agents are used, the material may no longer appear white but may have a blue, purple, or green tinge. Typical fluorescent whitening agents are derived from stilbene compounds, cumarins, benzocumarins, pyrazines, pyrazolines, oxazines, dibenzoxazolyl or dibenzimidazolyl compounds and naphthalimides, with stilbene among the most common. Exemplary fluorescent whitening agents are disclosed in U.S. Pat. No. 3,951,588, issued Apr. 20, 1976 to Perrin et al.; U.S. Pat. No. 4,140,852, "Triazinyl Styryl-Benzoxazole Fluorescent Dyestuffs," issued Feb. 20, 1979 to Eckstein and Harnisch; U.S. Pat. No. 3,951,588, "Process for Dyeing and Printing or Optical Brightening of Cellulose," issued Apr. 20, 1976; U.S. Pat. No. 4,228,071; "Triazine Containing Fiber-Reactive Disazo Dyestuffs," issued Oct. 14, 1980 to Riat and Seltz; U.S. Pat. No. 4,134,724, issued Jan. 16, 1979 to Thompson et al.; and U.S. Pat. No. 4,141,890 issued Feb. 27, 1979 to Hegar and Back, all of which are herein incorporated by reference.

While many optical brighteners or whitening compounds used in the art of papermaking have anionic groups that might be able to form bonds with cationic wet strength additives, fiber-reactive whitening compounds have not been used in a manner that can provide improved wet strength in paper or improved retention of wet strength compounds. Indeed, when possible interactions between whitening compounds and wet strength agents have been considered, it has been taught that the whitener should be added to the pulp after the wet strength agent has been added, as in German Patent No. DE 1,283,083, published Nov. 14, 1968 by H. E. Gottgens and H. Tretter of Bayer AG, in which case no improved retention of the wet strength agent by means of increased anionic sites on the fiber can be expected. Further, it has been taught that cationic polymer additives hinder the brightening effect of fluorescent whitening additives and can increase the apparent yellowness of a sheet by quenching fluorescence (B. W. Crouse and G. H. Snow, "Fluorescent Whitening Agents in the Paper Industry," *Tappi J.*, Vol. 64, No. 7, July 1981, pp. 87–89). The possibility of negative interactions between cationic agents and fluorescent whitening agents was also recognized by H. Geenen in "Possibilities for Improving Paper Brightness," *Wochenblatt Papierfabr.*, vol. 114, no. 2, end January 1986, pp. 41–42.

Reactive optical brighteners and fluorescent whitening agents are now rarely if ever used in the paper industry because of the tendency to hydrolyze when added to aqueous suspensions and because of other problems associated with the reactivity of the compounds. Indeed, as of 1998, it appears that no supplier of dyes and dyestuffs produces commercially available fiber reactive optical brighteners for use in the paper industry. Thus, the potential benefits of fiber reactive optical brighteners for papermaking properties appear not to have been recognized.

While fiber reactive forms may not be in use in the paper industry, non-reactive fluorescent whitening agents and optical brighteners are widely used. While the major uses are probably for improving the brightness of coated and uncoated printing and writing papers, one possible use is in the prevention of photoyellowing of high-yield fibers, particularly TMP and BCTMP. The lignin compounds in high-yield pulps can rapidly degrade to produce a yellow color upon exposure to UV light. The yellowing of newspaper, which usually comprises TMP or groundwood, is well known, but there are many other products for which yellowing is problematic. Paper towels and bath tissue, for example, can become yellow due to the ultraviolet component of ordinary fluorescent lights while sitting on the shelf of a grocery store.

In theory, if a compound absorbs UV energy, it may prevent the UV energy from causing reactions in the lignin that lead to yellowing. Ideally, the UV absorbing agent should be able to continually absorb UV energy and re-emit a portion of it as fluorescence rather than decomposing rapidly due to the energy absorbed. For this reason, fluorescent whitening agents appear to have promise in shielding high-yield pulps from the yellowing caused by UV light, and in hiding the yellowish tinge of such pulps through the addition of blue light from the fluorescence. While stilbene structures in high-yield pulp contribute to yellowing, especially in pulps bleached with peroxides (see "Reactive Structures in Wood and High-Yield Pulps; Daylight-Induced Oxidation of Stilbene Structures in the Solid State," by L. M. Zhang and G. Gellerstedt, *Acta Chem. Scand.* 48, no. 6: 490–497, June 1994), stilbene derivatives that function as UV absorbers may be able to reduce yellowing of high-yield paper by shielding lignin from UV. However, for durable materials or products intended for long-term use or long shelf lives, there is the risk that stilbene additives themselves will lead to yellowing with time, typically due to oxidative reduction of the double bond in the stilbene group. The decomposition of the stilbene derivative can lead to production of yellow chromophores or other undesired products. (Thioglycolic acid is known to cause some degree of photostabilisation of natural stilbene compounds in high-yield pulps, but poses other difficulties associated with sulfur compounds and with cost.) For this reason, it may be desirable for some products to avoid the use of stilbene derivatives altogether. For example, products comprising high brightness fibers such as bleached kraft fibers may be unsuited for the use of fluorescent whitening agents or stilbene derivatives in particular, if such compounds may degrade to give yellow chromophores. Further, in some countries, optical brighteners or fluorescent whitening agents are not permitted in paper packaging which may contact food. Further still, for some products and materials it is desirable that the hue or shade or white not be affected by the presence of UV light (i.e., the degree of whiteness or brightness is similar for both incandescent and fluorescent lights or incandescent light and sunlight). In such cases, the paper web should be substantially free of fluorescent whitening agents such that the web does not fluoresce in UV light. Thus, fluorescent whitening agents may not be desirable for all grades, but may be suited for high-yield grades, especially for disposable products where short-term protection from photoyellowing is needed.

Thus, in terms of fluorescent whitening agents, some applications may benefit from a synergistic use of fluorescent whitening agents that also promote improvements in non-optical properties of the web such as wet strength, while other applications may not be benefited by use of fluorescent whitening agents.

Therefore, an object of the present invention is to increase the number of anionic sites on the surface of papermaking fibers by pretreating the fibers, thus increasing the substantivity of subsequently added cationic wet strength agents that form covalent bonds with the cellulose. A further object of the present invention is to provide a means of increasing both the wet strength and the brightness of a web, particularly a web comprising high-yield papermaking fibers. A further object of the present invention is substantially increasing the wet strength of paper that can be achieved with a given dose of wet strength agent.

SUMMARY OF THE INVENTION

It has now been discovered that the wet strength of paper can be increased by adding certain fiber reactive anionic compounds to the papermaking furnish prior to the addition of cationic wet strength agents. The fiber reactive anionic compounds can be a fluorescent whitening agent, or not.

More specifically, in one aspect the invention resides in a method for making wet strength paper comprising the steps of:

a) providing an aqueous slurry of cellulosic papermaking fibers;

b) adding a substantially colorless reactive anionic compound to said aqueous slurry, said reactive anionic compound having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is NH or

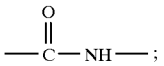

X is a moiety suitable for forming a covalent bond to a hydroxyl group on cellulose, selected from the group consisting of monohalotriazine, dihalotriazine, trihalopyrimidine, dihalopyridazinone, dihaloquinoxaline, dihalophtalazine, halobenzothiazole, acrylamide, vinylsulfone, β-sulfatoethylsylfonamide, β-chloroethylsulfone, and methylol;

B is hydrogen, a group of the formula Y—R (wherein Y and R are defined as above), or a group of the formula Y—R—W (wherein Y, R, and W are defined as above);

c) adjusting the pH and temperature of said aqueous slurry to promote reaction of the reactive anionic compound with the cellulosic fibers;

d) adding a cationic wet strength agent and water to said aqueous slurry to create a papermaking furnish;

e) depositing said papermaking furnish on a foraminous surface to form an embryonic web; and f) drying the web.

In another aspect, the invention resides in a method for making wet strength paper comprising the steps of:

a) providing an aqueous slurry of cellulosic papermaking fibers;

b) adding a substantially colorless reactive anionic compound to said aqueous slurry, said reactive anionic compound having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is a linking group selected from —NH—, —$SO_2$—, —CO— and —CONH—;

X is a fiber reactive group capable of forming a covalent bond to a hydroxyl group on cellulose;

B is hydrogen, a group of the formula Y—R (wherein Y and R are defined as above), or a group of the formula Y—R—W (wherein Y, R, and W are defined as above);

c) adjusting the pH and temperature of said aqueous slurry to promote reaction of the reactive anionic compound with the cellulosic fibers;

d) adding a cationic wet strength agent and water to said aqueous slurry to create a papermaking furnish;

e) depositing said papermaking furnish on a foraminous surface to form an embryonic web; and (f) drying the web.

In another aspect, the invention resides in a method for producing wet strength paper having improved optical properties, comprising the steps of:

a) providing an aqueous slurry of cellulosic papermaking fibers;

b) adding an anionic fiber reactive fluorescent whitening agent to said slurry;

c) adjusting the pH and temperature of said aqueous slurry to promote reaction of the anionic fiber reactive fluorescent whitening agent with the cellulosic fibers such that a substantial portion of the anionic fiber reactive fluorescent whitening agent becomes covalently bonded to said cellulosic papermaking fibers;

d) adding water and a cationic wet strength agent to said aqueous slurry to create a dilute papermaking furnish, such that a substantial portion of said cationic wet strength agent can form ionic bonds with said anionic fiber reactive fluorescent whitening agent covalently bonded to the cellulosic papermaking fibers;

e) depositing said papermaking furnish on a foraminous surface to form an embryonic web; and f) drying the web.

In another aspect, the invention resides in a wet-strength paper web comprising:

a) cellulosic papermaking fibers;

b) from about 0.02 to about 1.5 dry weight percent, based on dry fiber, of a cationic wet strength additive; and c) from about 0.01 to about 4 dry weight percent, based on dry fiber, of a reactive anionic compound, said reactive anionic compound being substantially colorless in both visible and UV light and having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is —OH— or —CONH—;

X is a fiber-reactive group suitable for forming a covalent bond to a hydroxyl group on cellulose; and B is hydrogen, a group of the formula Y—R (wherein Y and R are defined as above), or a group of the formula Y—R—W (wherein Y, R, and W are defined as above).

In a further aspect, the invention resides in a method of preparing paper with relatively high wet strength and low dry strength by first increasing anionic sites on the cellulose fibers with a fiber reactive anionic compound as described above, followed by addition of a chemical debonder agent and a cationic wet strength agent. The debonder agent can be applied to the fibers while the fibers are in solution, followed by addition of the cationic wet strength agent, whereafter the paper is formed, dewatered, and dried. Alternatively, the debonder agent may be applied to a dried or partially dried paper web that has been prepared with a fiber reactive anionic compound and a cationic wet strength agent. In either case, the debonder agent interferes with hydrogen bond formation, reducing the dry strength of the paper, while having relatively little effect on covalent bond formation. The result is a paper with an increased wet:dry tensile strength ratio. Such paper can have reduced stiffness and improved softness due to the reduced extent of hydrogen bonding, while still having high wet strength. The reactive anionic compound, however, can also lead to improved dry strength of the paper, especially if it contains two or more reactive groups, but also by virtue of increasing the efficiency of the wet strength additive. Improved strength without refining the fibers can permit harsher creping or other mechanical softening treatments for a bulkier, softer material. Thus, the invention also resides in a method of improving multiple material properties of a tissue web, including wet strength, through the synergistic use of anionic fiber reactive additives and cationic wet strength agents, followed by mechanical softening such as creping.

In contrast to the most common methods of adding dyestuffs to cellulose, the methods of the present invention do not require a salting step wherein sodium chloride or other salts are added in high concentration to the liquid phase to force the dye to affix to the fiber or precipitate on the fiber due to the common ion effect. In particular, the method of affixing the reactive anionic compound (analogous to a "colorless dye") to cellulosic fibers at elevated consistency can be done with no need for salt addition, with no need for a subsequent washing step to remove the salt or byproducts of the reaction, and with very little process water in general. Thus, in contrast to conventional textile dyeing technology, the present invention modifies the fibers in a way that reduces water usage and water pollution (particularly pollution due to salt content in the water). Therefore, in another aspect, the present invention can provide a process for improving the wet strength of paper through the use of colorless fiber reactive compounds via a method that is free of at least one of a salting step and a washing step after addition of the reactive anionic compound and prior to depositing the furnish on a foraminous surface.

When practicing a method of this invention, the wet strength that can be achieved with a given quantity of wet strength resin can be increased by a factor of about 20 percent or greater, more specifically about 40 percent or greater, more specifically about 50 percent or greater, and most specifically about 70 percent or greater. In addition, methods of this invention can achieve wet tensile strength values in substantially unrefined paper of about 1500 grams per inch (g/in) or greater, preferably about 2000 g/in or greater, and most preferably about 2300 g/in or greater, based on a 60 gsm Tappi handsheet. Also, wet:dry strength ratios can be attained which are about 0.2 or greater, more specifically about 0.3 or greater, more specifically about 0.4 or greater, more specifically about 0.5 or greater, and still more specifically from about 0.2 to about 0.5.

Creped or throughdried tissue webs made according to the present invention can be particularly useful as disposable consumer products and industrial or commercial products. Examples include paper towels, bath tissue, facial tissue, wet wipes, absorbent pads, intake webs in absorbent articles such as diapers, bed pads, meat and poultry pads, feminine care pads, and the like. Uncreped through-air dried webs having high wet strength and preferably having a basis weight from about 10 gsm to about 80 gsm, alternatively from about 20 to about 40 gsm, may be particularly useful as wet resilient, high bulk materials for absorbent articles and other uses, as illustrated by way of example in commonly owned copending U.S. application, Ser. No. 08/614,420, "Wet Resilient Webs and Disposable Articles Made Therewith," by F.-J. Chen et al., herein incorporated by reference.

Certain embodiments of the invention are directed to the additional optical properties of the web that are affected by the presence of reactive anionic compounds bound to cellulose in wet strength paper. In one embodiment of the invention, the reactive anionic compound does not fluoresce in ultraviolet light and preferably does not absorb strongly in UV or visible light, being colorless or substantially colorless in UV and visible light. Alternatively, for some pulps, a reactive anionic compound which strongly absorbs UV light may be desirable. Thus in a separate embodiment, the reactive anionic compound can comprise a UV absorbing group which can serve to shield lignin from photoyellowing in high-yield paper, or can contain a fluorescent group which can improve the optical brightness of the paper in UV-containing light, as well as decrease the apparent yellowness of the paper by increasing the intensity of the blue component of light leaving the paper.

DEFINITION OF TERMS AND TEST PROCEDURES

As used herein, "colorless" in terms of a chemical compound means that the compound does not absorb light strongly in the visible spectrum. Thus, a colorless compound, when applied to a white sheet of paper, will not alter the human visual perception that the sheet is white (as opposed to red or blue or some other visible color) when under ordinary white incandescent light, substantially regardless of concentration. More specifically such a compound can be said to be "colorless in visible light" (synonymous with simply "colorless" as used herein). If a colorless compound also does not absorb ultraviolet light strongly (particularly in the wavelength range of about 330 to about 380 nm), then, as used herein, that compound is "colorless in UV and visible light," though humans are not gifted with the ability to distinguish color in the UV spectrum. Fluorescent whitening agents are not "colorless in UV and visible light" because of their strong absorption of UV light, even though such compounds appear substantially colorless to the human eye when applied to paper.

"Papermaking fibers," as used herein, include all known cellulosic fibers or fiber mixes comprising cellulosic fibers. Fibers suitable for making the webs of this invention comprise any natural or synthetic cellulosic fibers including, but not limited to: nonwoody fibers, such as cotton liners and other cotton fibers or cotton derivatives, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, aspen, or the like. Woody fibers may be prepared in high-yield or low-yield forms and may be pulped in any known method, include kraft, sulfite, groundwood, thermomechanical pulp (TMP), chemithermomechanical pulp (CTMP) and bleached chemithermomechanical pulp (BCTMP). High brightness pulps, including chemically bleached pulps, are especially preferred for tissue making, but unbleached or semi-bleached pulps may also be used. Recycled fibers are included within the scope of the present invention. Any known pulping and bleaching methods may be used.

Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, sulfonated fibers, and the like. Suitable papermaking fibers may also include recycled fibers, virgin fibers, or mixes thereof.

As used herein, "high yield Pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP) pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers can have lignin content by mass of about 1 percent or greater, more specifically about 3 percent or greater, still more specifically from about 2 percent to about 25 percent. Likewise, high yield fibers can have a kappa number greater than 20 or greater than 30, for example. The preferred high yield pulp fibers, after being prepared by pulping and optional bleaching steps and prior to being formed into dry bales or webs, in one embodiment can also be characterized by being comprised of comparatively whole, relatively undamaged fibers, high freeness (250 Canadian Standard Freeness (CSF) or greater, more specifically 350 CSF or greater, and still more specifically 400 CSF or greater), and low fines content (less than 25 percent, more specifically less than 20 percent, still more specifically less that 15 percent, and still more specifically less than 10 percent by the Britt jar test). In one embodiment, the high-yield fibers are preferably predominately softwood, more preferably northern softwood.

As used herein, the term "cellulosic" is meant to include any material having cellulose as a major constituent, and specifically, comprising at least 50 percent by weight cellulose cellulose or a cellulose derivative. Thus, the term includes cotton, typical wood pulps, cellulose acetate, cellulose triacetate, rayon, thermomechanical wood pulp, chemical wood pulp, debonded chemical wood pulp, milkweed, and the like.

As used herein, a "wet strength agent" is any material that when added to a paper web or sheet results in providing the sheet with a wet geometric tensile strength to dry geometric tensile strength ratio in excess of 0.1. Typically these materials are termed either as "permanent" wet strength agents or as "temporary" wet strength agents. For the purposes of differentiating permanent from temporary wet strength, permanent wet strength agents are defined as those resins which, when incorporated into paper or tissue products, will provide a product that retains 50 percent or more of its original wet strength after exposure to water (i.e., saturation into deionized water at 73° F.) for a period of at least five minutes. Temporary wet strength agents are those which show less than 50% of their original wet strength after exposure to water for five minutes. Both classes of material find application in the present invention. The present invention is particularly concerned with wet strength resins that are cationic and especially polycationic polymers. "Water retention value" (WRV) is a measure that can be used to characterize some fibers useful for purposes of this invention. WRV is measured by dispersing 0.5 grams of fibers in deionized water, soaking overnight, then centrifuging the fibers in a 1.9 inch ter tube with a 100 mesh screen at the bottom at 1000 G for 20 minutes. The samples are weighed, then dried at 105° C. for two hours and then weighed again. WRV is (wet weight—dry weight)/dry weight. Fibers useful for purposes of this invention can have a WRV of about 0.7 or greater, more specifically from about 1 to about 2. High yield pulp fibers typically have a WRV of about 1 or greater.

As used herein, "Absorbent Capacity" refers to the amount of distilled water that an initially 1-inch cube of densified absorbent fibrous material can absorb while in contact with a pool of room-temperature water and still retain after being removed from contact with liquid water and held on a metal screen and allowed to drip for 30 seconds. Absorbent capacity is expressed as grams of water held per gram of dry fiber. Densified pads of the present invention have water retention values of about 5 g/g or greater, preferably about 7 g/g or greater, more preferably from about 8 g/g to about 15 g/g, and most preferably about 9 g/g or greater.

As used herein, "bulk" and "density," unless otherwise specified, are based on oven-dry mass of a sample and a thickness measurement made at a load of 0.05 psi with a three-inch diameter circular platen. Thickness measurements of samples are made in a Tappi conditioned room (50% RH and 73° F.) after conditioning for at least four hours. Samples should be essentially flat and uniform under the area of the contacting platen. Bulk is expressed as volume per mass of fiber in cc/g and density is the inverse, g/cc.

As used herein, the "wet:dry ratio" is the ratio of the geometric mean wet tensile strength divided by the geometric mean dry tensile strength. Geometric mean tensile strength (GMT) is the square root of the product of the machine direction tensile strength and the cross-machine direction tensile strength of the web. Tensile strengths are measured with standard Instron test devices having a 5-inch jaw span using 1-inch wide strips of tissue, conditioned at 50% relative humidity and 72° F. for at least 24 hours, with the tensile test run at a crosshead speed of 1 in/min.

BRIEF DESCRIPTION OF THE DRAWINGS

FIG. 2 depicts measured wet tensile strength in grams of force per inch; FIG. 3 depicts results for dry tensile strength; FIG. 4 depicts wet TEA (total energy absorbed)

DETAILED DESCRIPTION OF THE INVENTION

Figure 1:
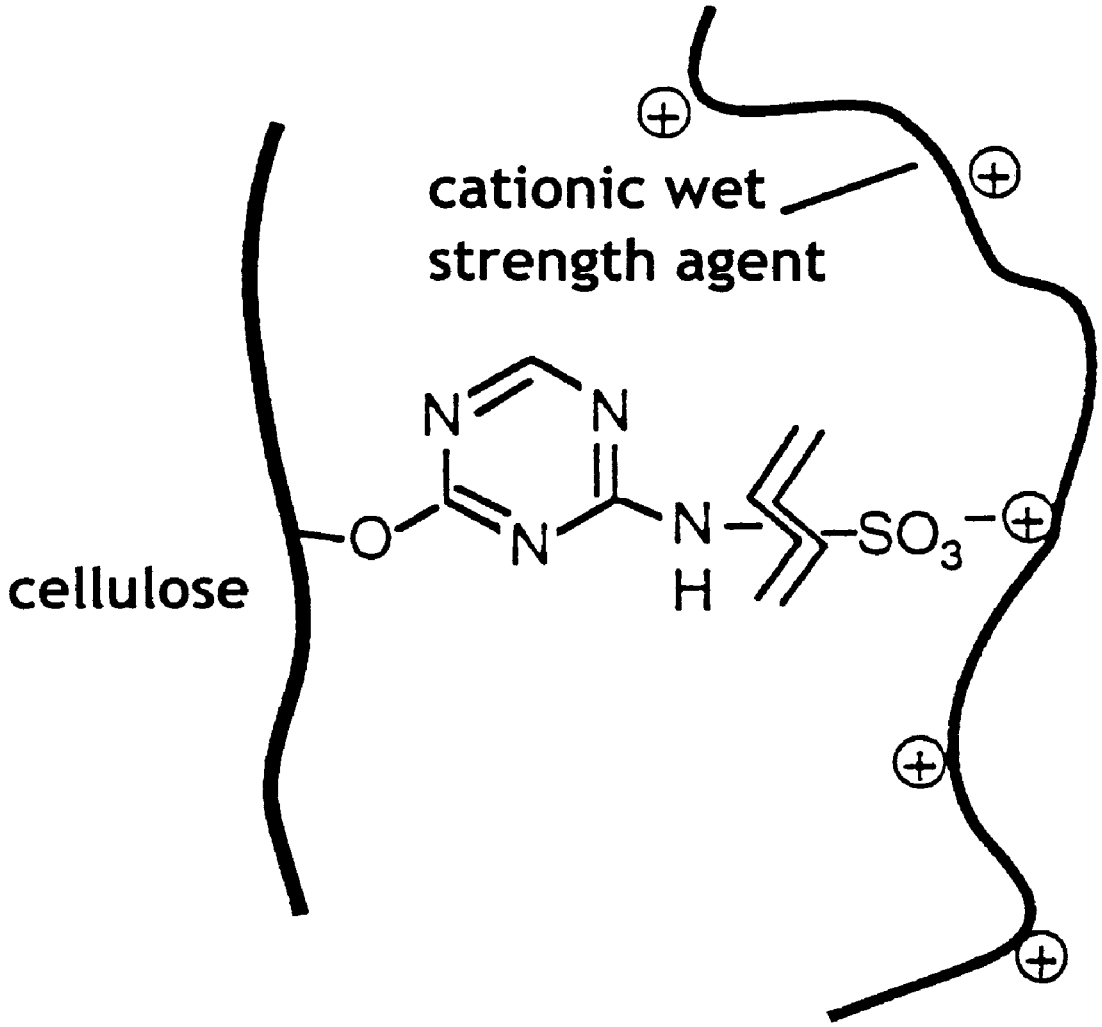
FIG. 1 depicts a characteristic fiber reactive anionic compound after reaction with a hydroxyl group on a cellulose fiber, wherein the anionic moiety of the fiber reactive anionic compound is engaged in an ionic bond with a cationic site of a cationic wet strength agent.

One aspect of the present invention is a multistep process for improving the wet strength and other physical properties of paper through the novel use of anionic fiber reactive agents. The anionic fiber reactive agents bond covalently to the hydroxyl groups of cellulose, providing new anionic sites to attract and retain subsequently added cationic polymers, particularly polycationic wet strength resins. Before describing the steps of the present invention, suitable fiber reactive compounds will be disclosed.

SUITABLE FIBER REACTIVE ANIONIC COMPOUNDS

Most generally, any known fiber reactive compound can be used provided it has the following properties:

a) It must be substantially colorless to permit its use in a wide range of paper products, such as white tissue. In one embodiment, it is also substantially colorless in ultraviolet and visible light. In another embodiment, it is substantially colorless in visible light but absorbs UV light strongly. In yet another embodiment, it is substantially colorless but fluoresces in UV light, as do fluorescent whitening agents (also known as optical brighteners).

b) It must contain anionic groups, such as sulfonyl or carboxyl groups, capable of forming ionic bonds with a polycationic polymer, particularly a polymer containing quaternary ammonium groups or other cationic groups typical of wet strength resins. The ionic bonds with cationic groups of a polymer help to form bridges between the fiber and the wet strength agent to hold the polymer on the fiber, thus increasing the effectiveness of a given dose of a cationic polymer, particularly a wet strength agent, in a papermaking furnish.

c) It must contain at least one fiber reactive group capable of forming covalent bonds with the hydroxyl groups of cellulose.

d) Preferably it is substantially water soluble, or at least soluble enough to permit effective reaction with cellulose in an aqueous slurry of papermaking fibers having a consistency of about 2 percent by weight or greater.

Such fiber reactive anionic compounds can be fiber reactive "dyes" modified to be without chromophore groups (i.e., colorless or substantially colorless) and further modified, if necessary, to ensure the presence of at least one anionic moiety such as a sulfonic or carboxylic group.

Specific examples of suitable reactive anionic compounds are given by the formula:

$$W—R—Y—X—B \quad (1)$$

wherein W is an anionic moiety, particularly sulfonyl or carboxyl or salts thereof;

R is a bridging group such as an aliphatic, an aromatic, an inertly or essentially inertly substituted aromatic, an aminoaryl such as a diaminostilbene group, a cyclic, a heterocyclic, optionally a heterocyclic comprising at least one 5- or 6-membered ring having 2 or 3 nitrogens, or an inertly or essentially inertly substituted heterocyclic radical; the bridging group being characterized by low absorption of visible light (i.e., not contributing to a colored appearance in visible white light), and preferably being resistant to attack or cleavage at 70° C. over a pH range of 6 to 8, preferably 6 to 9, more preferably 5 to 9, and most preferably 4 to 10;

Y is a linking group such as —NH— (preferably), $—SO_2—$, —CO—, —C—; or —CONH—, which is:

$$—\overset{\overset{\displaystyle O}{\|}}{C}—NH—;$$

X is a fiber reactive group suitable for forming a covalent bond on cellulose such as an ether-type linkage to a hydroxyl group on cellulose, selected according to principles and examples disclosed hereafter; and B is either hydrogen, a group of the formula Y—R (wherein Y and R are defined as above), or a group of the formula Y—R—W (wherein Y, R, and W are defined as above).

A particular commercially available example of a suitable fiber reactive anionic compound, discovered to be useful for the present invention, is the nylon dye retardant Sandospace S produced by Clariant Corp., Charlotte, N.C. While the formula of Sandospace S is proprietary, chemical analysis and partial information from the supplier confirms that it has a chlorinated triazine group, aromatic structures, and sulfonic groups.

In one embodiment, the fiber reactive group X is selected from the group consisting of monohalotriazine, dihalotriazine, trihalopyrimidine, dihalopyridazinone, dihaloquinoxaline, dihalophtalazine, halobenzothiazole, haloacrylamide, vinylsulfone, β-sulfatoethyl-sulfonamide, β-haloethylsulfone, and methylol, with dihalotriazine believed to be particularly advantageous because of an ability to allow reaction with the fiber to occur at lower temperatures than monohalotriazine and related compounds; and with chlorine as the preferred halogen. In another preferred embodiment, the fiber reactive moiety or group is a halo-substituted six-membered heterocyclic radical with two or three ring nitrogen atoms, said group being capable of reacting with the hydroxyl groups of cellulose, wherein said fiber reactive group is bonded to the rest of the compound via an —NH— linkage (i.e., group Y is —NH—).

Hegar and Back in U.S. Pat. No. 4,141,890, issued Feb. 27, 1979, herein incorporated by reference, list a variety of acylating agents containing a fibre-reactive radical, which may be used in the production of fiber reactive dyestuff. Such acylating agents can also be of value in the production of colorless fiber reactive groups according to the present invention using techniques known to those skilled in the art through reaction to join the acylating agent to a bridging group or other molecular components connected to anionic groups. These acylating agents include: chloroacetyl chloride or bromoacetyl chloride, beta-chloropropionyl or beta-bromopropionyl chloride, alpha, beta-dichloropropionyl or alpha, beta-dibromopropionyl chloride, chloromaleic anhydride, carbyl sulphate, acrylyl chloride, beta-chloroacrylyl or beta-bromoacrylyl chloride, alpha-chloroacrylyl or alpha-bromoacrylyl chloride, alpha, beta-dichloroacrylyl or alpha, beta-dibromoacrylyl chloride, trichloroacrylyl chloride, chlorocrotonyl chloride, propiolic acid chloride, 3,5-dinitro-4-chlorobenzene-sulphonic acid chloride or -carboxylic acid chloride, 3-nitro-4-chlorobenzene-sulphonic acid chloride or -carboxylic acid chloride, 2,2,3,3-tetrafluorocyclobutane-1-carboxylic acid chloride, beta-chloroethylsulphonyl-endomethylene-cyclohexanecarboxyl ic acid chloride, acrylsulphonyl-endomethylene-cyclohexanecarboxylic acid chloride and above all heterocyclic acid halides and their derivatives, such as the 2-chlorobenzoxazolecarboxylic acid chlorides, 2-chlorobenzthiazolecarboxylic or -sulphonic acid chlorides and above all the following compounds possessing at least 2 nitrogen atoms as hetero-atoms of a 6-membered heterocyclic structure: 4,5-dichloro-1-phenylpyridazonecarboxylic or -sulphonic acid chloride, 4,5-dichloropyridazonepropionic acid chloride, 1,4-dichlorophthalazine carboxylic or -sulphonic acid chloride, 2,3-dichloroquinoxalinecarboxylic or -sulphonic acid chloride, 2,4-dichloroquinazolinecarboxylic or -sulphonic acid chloride, 2-methanesulphonyl-4-chloro-6-methylpyrimidine, tetrachloropyridazine, 2,4-bis-methanesulphonyl-6-methylpyrimidine, 2,4,6-tri- or 2,4,5,6-tetrachloropyrimidine, 2,4,6-tri- or 2,4,5,6-tetrabromopyrimidine, 2-methanesulphonyl-4,5-dichloro-6-methylpyrimidine, 2,4-dichloropyrimidine-5-sulphonic acid, 5-nitro- or 5-cyano-2,4,6-trichloropyrimidine,2,6-bis-methanesulphonylpyridine-4-carboxylic acid chloride, 2,4-dichloro-5 -chloromethyl-6-methyl-pyrimidine, 2,4-dibromo-5-bromomethyl-6-methylpyrimidine, 2,4-dichloro-5-chloromethylpyrimidine, 2,4-dibromo-5-bromomethylpyrimidine, 2,5,6-trichloro-4-methylpyrimidine, 2,6-dichloro-4-trichloromethylpyrimidine or especially 2,4-dimethylsulphonyl-5-chloro-6-methylpyrimidine, 2,4,6-trimethylsulphonyl-1,3,5-triazine, 2,4-dichloropyrimidine, 3,6-dichloropyridazine, 3,6-dichloropyridazine-5-carboxylic acid chloride, 2,6-dichloro- or 2,6-dibromo-4-carboethoxypyrimidine, 2,4,5-trichloropyrimidine, 2,4-dichloropyrimidine-6-carboxylic acid chloride, 2,4-dichloropyrimidine-5-carboxylic acid chloride, 2,6-dichloro- or 2,6-dibromopyrimidine-4- or -5-carboxylic acid amides or -sulphonic acid amides or -4- or -5-sulphonic acid chloride, 2,4,5,6-tetrachloropyridazine, 5-bromo-2,4,6-trichloropyrimidine, 5-acetyl-2,4,6-trichloropyrimidine, 5-nitro-6-methyl-2,4 -dichloropyrimidine, 2-chlorobenzthiazole-6-carboxylic acid chloride, 2-chlorobenzthiazole-6-sulphonic acid chloride, 5-nitro-6-methyl-2,4-dichloropyrimidine, 2,4,6-trichloro-5-chloropyrimidine, 2,4,5,6-tetrafluoropyrimidine, 4,6-difluoro-5-chloropyrimidine, 2,4,6-trifluoro-5-chloropyrimidine, 2,4,5-trifluoropyrimidine, 2,4,6-trichloro-(-tribromo- or -trifluoro)-1,3,5 -triazines, as well as 4,6-dichloro(dibromo- or -difluoro)-1,3,5 -triazines which are substituted in the 2-position by an aryl or alkyl radical, for example a phenyl, methyl or ethyl radical, or by the radical of an aliphatic or aromatic mercapto compound bonded via the sulphur atom, or by the radical of an aliphatic or aromatic hydroxy compound bonded via the oxygen atom, or, in particular, by an $NH_2$ group or by the radical of an aliphatic, heterocyclic or aromatic amino compound bonded via the nitrogen atom. As such compounds, the radicals of which can be bonded in the 2-position to the triazine nucleus by reaction with trihalotriazines, the following may for example be mentioned: aliphatic or aromatic mercapto or hydroxy compounds, such as thioalcohols, thioglycolic acid, thiophenols, alkoxyalkanols, methyl alcohol, ethyl alcohol or isopropyl alcohol, glycolic acid, phenol, chlorophenols or nitrophenols, phenolcarboxylic and phenolsulphonic acids, naphthols, naphtholsulphonic acids and the like, but in particular ammonia and compounds containing amino groups which can be acylated, such as hydroxylamine, hydrazine, phenylhydrazine, phenylhydrazinesulphonic acids, glycolmonoalkyl ethers, methylamine, ethylamine, isopropylamine, methoxyethylamine, methoxypropylamine, dimethylamine, diethylamine, methylphenylamine, ethylenephenylamine, chloroethylamine, ethanolamines, propanolamines, benzylamine, cyclohexylamine, morpholine, piperidine, piperazine aminocarbonic acid esters, aminoacetic acid ester, aminoethane-sulphonic acid, N-methylaminoethanesulphonic acid, and aromatic amines, such as aniline, N-methylaniline, toluidines, xylidines, chloroanilines, p- or m-aminocetanilide, aminophenols, anisidine, phenetidine and, in particular, anilines containing acid groups, sulphanilic acid, methanilic acid, orthanilic acid, anilinedisulphonic acid, aminobenzylsulphonic acid, anilinemethanesulphonic acid, aminobenzenedicarboxylic acids, naphthylaminomonosulphonic, -disulphonic and -trisulphonic acids, aminobenzoic acid, such as 2-hydroxy-5-aminobenzoic acid, and also stilbene compounds such as those used in fluorescent whitening agents.

In addition to the fiber-reactive radicals which can be introduced to a colorless compound by acylation, further such radicals which may be mentioned are, for example, the vinylsulphone, the beta-sulphato- or thiosulphatoethylsulphone, beta-thiosulphatopropionylamide, the beta-thiosulphatoethylsulphonylamide or the sulphonic acid-N, beta-sulphatoethylamide groups, which are introduced into the reactive anionic compound in another way, for example by ester formation or thioester formation.

Among examples of compounds which contain a fiber-reactive radical that cannot be introduced by acylation, and in which the fiber-reactive radical is therefore preferably not bonded via an amino group, but is bonded directly to a benzene radical or aryl group, the sulpho esters of the following sulphones may, in particular, be mentioned: 1-amino-2-methoxy-5-(beta-hydroxyethyl)-phenylsulphone, 1-aminobenzene-3- or 4-beta-hydroxyethylsulphone, 1-amino-2-methyl-benzene-5-beta-hydroxyethylsulphone, 1-amino4-(beta-hydroxyethylsulphonylpropionylaminomethyl)-benzene, 1-amino-4-(beta-hydroxyethylsulphonylamino)-benzene, as well as reactive compounds which can be obtained via the appropriate methylols by Einhorn's method, for example 1-amino-4-chloroacetylaminomethyl-benzene or 1-amino-3-chloroacetylaminomethyl-benzene-6-sulphonic acid.

Condensation with the acid halides or anhydrides, or with the heterocyclic halogen compounds, is advantageously carried out in the presence of acid acceptors, for example sodium carbonate. It is to be understood that preparation of the fiber reactive compounds of Hegar and Back is to be carried out in such a manner that an unsaturated bond or at least a replaceable halogen atom still remains in the final product to permit formation of a covalent bond with the hydroxyl group of cellulose under suitable conditions of pH, concentration, and temperature.

Formula (1) above provides one class of suitable structures. Related structures within the scope of this invention can have multiple sulfonyl or carbonyl groups attached to various locations of the molecule, including on segments of the bridging group or even directly attached to part of the fiber reactive group. Multiple fiber reactive groups may also be attached to one or more bridging groups, allowing the reactive anionic compound to attach to multiple adjoining sites on a cellulose surface. Species according to formula (1) which can complex with metal ions are also within the scope of the present invention, provided that the resulting compound in its dry state on cellulose reamins substantially colorless.

Examples of halo-triazine derivatives of use in the present invention include known halo-1,3,5-s-triazinyl-diamino-stilbene-disulfonic acid derivatives used as fluorescent whitening agents or as ultraviolet absorbers. Chlorotriazinyl intermediates of commercially available non-reactive fluorescent whitening agents, particularly those derived from cyanuric acid and diaminostilbene, are likely to be useful fiber reactive compounds which may also be of value in preventing photoyellowing of high-yield fibers. One commercial fiber-reactive triazinyl ultraviolet absorber (but not a fluorescent whitening agent) is RAYOSAN CO Liquid, produced by Clariant Corp. (Charlotte, N.C.). RAYOSAN, like many other fiber-reactive compounds, requires a temperature above about 160° F. and a pH of about 9.5 or higher for efficient reaction of the fiber reactive radical with hydroxy groups on cellulose, according to the manufacturer. RAYOSAN CO does not appear to effectively absorb the UV frequency range typical of fluorescent lights, and thus is not a preferred fiber reactive compound for preventing yellowing from such lights, but may be of value for other purposes.

Examples of pyridone derivatives of use in the present invention include those of the formula (2)

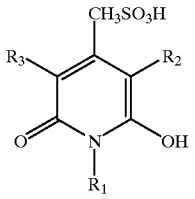

related to the compounds taught in U.S. Pat. No. 4,092,308, issued May 30, 1978 to Hegar, herein incorporated by reference. At least one of $R_1$, $R_2$, and $R_3$ contains a fiber reactive group such as a chlorotriazine or any of the other suitable fiber reactive groups previously disclosed, in which case the fiber reactive containing radical $R_1$, $R_2$, or $R_3$ can be represented as —Y—X—B, wherein Y,X, and B have meanings previously defined. When not a fiber reactive containing radical, then $R_1$ represents a hydrogen atom, an alkyl or aryl radical, $R_2$ and $R_3$ represent independently a hydrogen or halogen atom, a cyano, carboxylic amide, alkylsulphonyl, arylsulphonyl, nitro, nitroso, amino, or acylamino group, or —NH—Z where Z is a heterocyclic or aromatic radical which can be derived from a compound of the anthraquinone, benzene, naphthalene, nitroaryl, phthalocyanine, or stilbene series or the like. The fiber reactive groups that can be one or more of $R_1$, $R_2$, and $R_3$ contain a linking group such as —NH— or —CONH— connected to a reactive radical of the classes previously disclosed.

The compounds of the formula (2) can exist in a number of tautomeric forms. In order to simplify the description the compounds in the formulae are illustrated in only one of these tautomeric forms, but it must be expressly emphasized that throughout this specification, especially in the claims, the description refers to compounds in any of these tautomeric forms.

In particular, the term "pyridone" is intended to include also the compounds in question which are substituted at the nitrogen atoms of the pyridone ring by a hydrogen atom as well as the corresponding tautomeric 2,6-dihydroxypyridones.

In addition to the sulphomethyl group, the pyridone compounds according to the invention preferably contain additional water-solubilizing groups such as sulphonic acid groups, carboxyl groups, or quaternized amino groups. The compounds can contain one or more than one reactive radical, for example, a halotriazine radical, in the molecule. In addition to being substituted by water-solubilizing groups, the compounds can be substituted in the normal way, by still further atoms or groups of atoms, and in particular in the radicals $R_1$, $R_2$ and $R_3$, for example by halogen atoms or hydroxy, amino, alkyl, aryl, alkoxy, aryloxy, acylamino, cyano, acyl, carbalkoxy, acyloxy or nitro groups, and the like.

Examples of pyrimidine derivatives of value for the present invention would include colorless forms of the fiber-reactive compounds disclosed in U.S. Pat. No. 4,007,164, "Azo Dyestuffs Containing 6-Fluoro-Pyrimidinyl 4-Reactive Group," issued Feb. 8, 1977 to Bien and Klauke, herein incorporated by reference. Removal of the azo groups or preparation of such compounds without addition of azo groups may be necessary to achieve a substantially colorless species. For the purpose of the present invention, the analogs to Bien and Klauke's compounds can be represented by the formula:

(3)

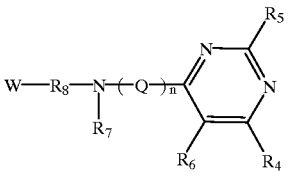

wherein $R_4$ is fluoro; $R_5$ is hydrogen, optionally alkyl, alkenyl, aralkyl, aryl, haloalkyl or haloallyl; $R_6$ is hydrogen or a substituent as defined hereafter; Q is a linking member, e.g. $SO_2$ or —CO—; n is the number 0 or 1; $R_7$ is hydrogen or lower alkyl; W is an anionic group as defined above; and $R_8$ is a bridge group such as R in formula (1) preferably containing an aromatic ring linked to the N adjacent $R_8$ as shown either directly or via a further bridge or linking member, such as —$SO_2$— or —CO—, as in the case of amide groupings, or via an alkylene group, an alkylene-CO—, an arylene-, arylene-$SO_2$—, arylene-CO— group or a triazine or diazine ring or an arylene-amidosulphonyl group. If such further linking members contain heterocyclic ring systems, as is the case with triazinyl or pryimidinyl radicals, these, too, may contain reactive atoms or groupings, such as halogen atoms or other substituents. Examples of substituents $R_6$ on the pyrimidine ring are: halogen, such as Cl, Br and F; alkyl radicals, such as —$CH_3$ and —$C_2H_5$; substituted alkyl radicals, such as mono-, di- or trichloro- or tribromomethyl, trifluoromethyl radicals; alkenyl radicals, such as vinyl or halovinyl and allyl radicals; —$NO_2$, —CN, carboxylic acid, carboxylic acid ester and optionally N-substituted carboxylic acid or sulphonic acid amide groups, sulphonic acid and sulphonic acid ester groups; alkyl-sulphonyl, aralkyl-sulphonyl or aryl-sulphonyl groups.

Adapting known reactive azo dyes for colorless fiber-reactive compounds obviously can be done by cleaving the azo group or by altering synthesis by not performing the normal step of coupling a diazonium salt with an electron-rich nucleophile, presuming that the nucleophile also contains or can be provided with the fiber reactive group and anionic compounds.

According to Hegar and Back in U.S. Pat. No. 4,141,890, previously incorporated by reference, groupings capable of being reactive with the hydroxyl groups of cellulose to form a covalent chemical bond include low molecular alkanoyl or alkylsulphonyl radical substituted by a removable atom or a removable group, a low molecular alkenoyl or alkene-sulphonyl radical optionally substituted by a removable atom or a removable group, a carboxylic or heterocyclic radical containing 4-, 5- or 6-membered rings which is substituted by a removable atom or a removable group and is bonded via a carbonyl or sulphonyl group, or a triazine or pyrimidine radical substituted by a removable atom or a removable group and directly bonded via a carbon atom, or such a grouping contains such a radical.

Other reactive radicals can be used, including those disclosed in the article "Dyes, Reactive" in Vol. 8 of the Kirk-Othmer Encyclopedia of Chemical Technology, Vol. 8, pp. 374–390, including chlorobenzothiazole or reactive acrylamide as used in BASF Primazin dyes. The fiber-reactive radical may also be a radical of the formula —N($R_9$)—Z, wherein $R_9$ represents a low molecular alkyl radical or preferably a hydrogen atom, and Z represents a dihalotriazine radical or a monohalotriazine radical. By low molecular alkyl radicals are meant in this context alkyl radicals with up to 4 carbon atoms, e.g. the methyl, ethyl, propyl, isopropyl, or butyl radical.

In U.S. Pat. No. 4,134,724 issued Jan. 16, 1979 to Thompson et al., herein incorporated by reference, discloses fiber reactive groups which may also be of value in the present invention, including ethylene sulfonimide and cyclic ethylene- immonium type species.

In a preferred embodiment, the reactive anionic compound is substantially water soluble and has a molecular weight of about 5,000 or less, more specifically about 3000 or less, more specifically about 1500 or less, and most specifically from about 300 to about 1000. Preferably, the reactive anionic compound comprises at least two sulfonic groups. Preferably, the reactive anionic compound comprises at least two heterocyclic rings and alternatively at least three heterocyclic rings.

THE METHOD OF USING THE REACTIVE ANIONIC COMPOUND

The first step in the method of this invention is providing an aqueous slurry of papermaking fibers. Any papermaking fibers, as previously defined, or mixtures thereof may be used. Because of commercial availability, softwood and hardwood fibers are especially preferred. In one embodiment, the fibers may be predominantly hardwood, such as at least 50% hardwood or about 60% hardwood or greater or about 80% hardwood or greater or substantially 100% hardwood. Higher hardwood contents art desired for high opacity and softness, whereas high softwood is desirable for strength. In another embodiment, the fibers may be predominantly softwood, such as at least 50% softwood or about 60% softwood or greater or about 80% softwood or greater or substantially 100% softwood. For many tissue applications, high brightness is desired. Thus the papermaking fibers or the resulting tissue or paper of the present invention can have an ISO brightness of about 60 percent or greater, more specifically about 80 percent or greater, more specifically about 85 percent or greater, more specifically from about 75 percent to about 90 percent, more specifically from about 80 percent to about 90 percent, and more specifically still from about 83 percent to about 88 percent. Best strength improvements are obtained with fibers that are not highly sulfonated, for the sulfonic groups on the pulp may already provide adequate anionic sites for attachment of cationic polymers. Some sulfonated BCTMP pulps, for example, may not show significant strength improvements if abundant sulfonic groups are already on the fibers.

The slurry preferably has a fiber consistency of about 1 or 2 percent or greater, more specifically about 3 percent or greater, more specifically about 5 percent or greater, more specifically about 8 percent or greater, more specifically about 10 percent or greater, more specifically about 15 percent or greater, more specifically about 20 percent or greater, more specifically from about 5 percent to about 50 percent and most specifically from about 10 percent to about 30 percent.

The second step of the present invention is chemical pretreatment of the fibers by adding an effective amount of a fiber reactive anionic compound to the fiber slurry. The preferred amount of fiber reactive anionic compound added to the fiber slurry is from about 0.01 to about 4 weight percent (wt %) based on the dry fiber weight, preferably from about 0.05 to about 2 wt %, more preferably from about 0.08 to about 1.5 wt %, and most preferably from about 0.1 to about 1 wt %. (All weight percentages referred to herein are on a dry basis unless otherwise stated.)

Whereas treatment with fiber reactive dyes are typically carried out in dilute slurries, such as about 2 percent consistency, it has been surprisingly discovered that the reaction of the present invention can be successfully carried out with low amounts of liquid. Thus successful operation is possible for higher consistency fiber slurries, including the consistencies previously mentioned. The reduced use of water improves process efficiency and reduces water treatment burdens, and may reduce the tendency of fiber reactive compounds to hydrolyze. For high consistency treatment, it is desirable to employ high consistency mixers such as those recently known in the art of papermaking and bleaching. Hobart batch mixers, for example, may be useful in preparing the slurry at high or medium consistency. Useful continuous high consistency mixers are produced by Sunds Defibrator, Norcross, Ga., and other vendors. For best results, mixing should be done with adequate shear to thoroughly and uniformly mix the reagents with the fiber slurry. Elevated temperature, possibly assisted with steam injection into the pulp, may be beneficial.

When high-yield pulps are used, it may be desirable for the reactive anionic compound to comprise a UV absorbing group or to contain a fluorescent whitening group capable of absorbing UV light and fluorescing.

The third step is adjusting the pH and temperature of the slurry to effectively drive the reaction between the fiber reactive anionic compound and the fiber. Once applied to an aqueous fiber slurry, the reactive anionic compound added in the second step may not react significantly with the cellulose until the pH is adjusted and the temperature is sufficiently high. The vast majority of suitable fiber reactive groups require alkalization, although a few fiber reactive groups such as methylol require acidic conditions. Alkalization is typically necessary to raise the pH to about 6 or greater, preferably about 7 or greater, more preferably about 8 or greater, still more preferably from about 8 to about 11, and most preferably from about 8 to about 10, in order to drive the reaction toward completion. Alkaline agents such as sodium hydroxide, trisodium phosphate, sodium bicarbonate, and sodium carbonate, either singly or in combination, are preferred for their low cost, their chemical effectiveness, their general compatibility with tissue making operations, and their ease of handling and processing, but other alkaline compounds may be selected as well, including but not limited to calcium oxide, potassium hydroxide, potassium carbonate, and related compounds. If acidification is necessary, sulfuric acid or other acids known in the art may be used.

Adjustment of pH of the fibrous slurry can be done either before, during, or after addition of the reactive anionic compound to the fibers in the second step. Based on experimental results with alkalization, alkalization after addition of the reactive anionic compound is preferred because it results in higher yield and efficiency (higher substantivity of the wet strength agent, manifest by higher wet strength of paper at a given dosage of wet strength agent). Without limitation, it is believed that alkalization too early in the process can cause some hydrolysis of the reactive group of the reactive anionic compound, resulting in lower yield.

In an especially preferred embodiment of the invention, slightly more of an alkaline compound is added to the slurry than would be needed to neutralize the acidic byproduct of reaction between the reactive anionic compound and a hydroxyl group of the cellulose. For example, when the reactive group is monochloro-triazine, the acidic byproduct is hydrogen chloride. Adding sufficient sodium hydroxide in the post-alkalization treatment to more than neutralize the hydrogen chloride, assuming complete reaction, has proven to be effective in achieving the desired reaction and the desired wet strength properties. Thorough mixing of the slurry during alkalization is desirable. When using high-yield pulps, care must be taken to avoid excessive exposure of the fibers to high pH and high temperature, since accelerated thermal yellowing may occur. It may be desirable to reduce the pH, such as to about 9 or lower, or to about 8 or lower, or to about 7 or lower, once fixation of the fiber reactive compound has been achieved through alkalization and pH elevation. Normal industrial papermaking conditions for tissue drying generally will not cause significant thermal yellowing.

A few fiber reactive groups known in the art, particularly methylolated nitrogen groups (—$NHCH_2OH$), should be applied under acidic conditions at elevated temperature. If such compounds are used, the step of pH adjustment would generally be acidification rather than alkalization. Reactions with methylol groups may require higher temperatures than are normally needed for most other fiber reactive groups, which can be harmful to fiber properties.

Simultaneously or subsequent to the pH adjustment, a temperature of from about 20° C. to about 150° C. is typically needed for practically rapid reaction rates with most fiber reactive species of use in the present invention, with a preferred temperature range of from about 20° C. to about 120° C., more preferably from about 20° C. to 100° C., more preferably still from about 40° C. to about 85° C., and most preferably from about 50° C. to about 80° C. Of course, the optimum temperature will depend on which fiber reactive anionic compound is used. If the slurry is below a suitable temperature range, temperature elevation may be achieved by contact heating through the use of a heat exchanger, heated vessel walls, steam injection, or any of the many means known in the art. For uniformity of reaction, good mixing of the slurry during heating is desirable. The adjustment of temperature need not be simultaneous with the addition of alkaline compounds or with the addition of fiber reactive anionic compound, but preferably will follow addition of the alkaline compound. The proper temperature should be maintained for a sufficient period of time to drive the reaction to a useful degree of completion.

If the reactive anionic compound comprises a group with fluorescent whitening functionality, various post-treatments may be needed after fiber reaction to achieve full fluorescent activity, as is known in the art. Adjustment of pH and washing or rinsing may be desirable. Such steps may be achieved during or as an inherent aspect of the subsequent steps given hereafter.

The fourth step is adding an effective amount of cationic wet strength agents and water to said aqueous slurry, creating a papermaking furnish. Mixtures of compatible wet strength resins, including those described previously, can be used in the practice of this invention. Additional compounds and fillers or solid components may be added simultaneously with the second step, or could even precede the second step, if desired, although better efficiency is obtained by performing the addition of cationic wet strength agents after chemical pretreatment of the fibers. Any amount of wet strength agent may be added, but for efficient use and reasonable cost it is desirable that about 30 pounds per ton or less (1.5 wt % or less) on a dry fiber basis be added, preferably from about 0.02 to about 1.5 wt %, more preferably from about 0.02 to about 1.0 wt %, and most preferably from about 0.05 to about 0.8 wt %. Any cationic wet strength agent suitable for papermaking may be used. For high wet resiliency tissue, agents preferably should be capable of cross-linking (auto-cross-linking or with cellulose) or be capable of forming covalent bonds with cellulose. In the usual case, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further, some resins are soluble only under specific conditions, such as over a limited pH range. Wet strength resins are generally believed to undergo a cross-linking or other curing reactions after they have been deposited on, within, or among the papermaking fibers. Cross-linking or curing does not normally occur so long as substantial amounts of water are present.

Particular permanent wet strength agents that are of utility in the present invention are typically water soluble, cationic oligomeric or polymeric resins that are capable of either crosslinking with themselves (homocrosslinking) or with the cellulose or other constituent of the wood fiber. Such compounds have long been known in the art of papermaking. See, for example, U.S. Pat. Nos. 2,345,543 (1944), 2,926,116 (1965) and 2,926,154 (1960), all herein incorporated by reference. One class of such agents include polyamine-epichlorohydrin, polyamide epichlorohydrin or polyamide-amine epichlorohydrin resins, collectively termed "PAE resins." These materials have been described in patents issued to Keim (U.S. Pat. Nos. 3,700,623 and 3,772,076 herein incorporated by reference) and are sold by Hercules, Inc., Wilmington, Del., as Kymene, e.g., Kymene 557H. Related wet strength agents are sold by Georgia Pacific under the name Amres, e.g., Amres 8855. Other suitable materials are marketed by Henkel Chemical Co., Charlotte, N.C. Materials developed by Monsanto and marketed under the Santo Res label are base-activated polyamide-epichlorohydrin resins that can be used in the present invention. These materials are described in patents issued to Petrovich (U.S. Pat. No. 3,885,158; U.S. Pat. No. 3,899,388; U.S. Pat. No. 4,129,528 and U.S. Pat. No. 4,147,586) and van Eenam (U.S. Pat. No. 4,222,921) all herein incorporated by reference.

Although they are not as commonly used in consumer products, polyethylenimine resins are also suitable for immobilizing fiber-fiber bonds. Another class of permanent-type wet strength agents includes aminoplast resins (e.g., urea-formaldehyde and melamine-formaldehyde).

The permanent wet strength agent is typically added to the paper fiber in an amount of about 20 pounds per ton (1.0 wt %) or less. The exact amount will depend on the nature of the fibers and the amount of wet strength required in the product. As in the case of the temporary wet strength agent, these resins are generally recommended for use within a specific pH range depending upon the nature of the resin. For example, the Amres resins are typically used at a pH of about 4.5 to 9. Addition of wet strength resins to papermaking fibers is typically conducted at low fiber consistency, such as about 2 percent or less and preferably about 1 percent or less or about 0.5 percent consistency.

Temporary wet strength agents are also useful in the method of this invention. Suitable cationic temporary wet strength agents can be selected from agents known in the art such as dialdehyde starch, polyethylene imine, mannogalactan gum, glyoxal, and dialdehyde mannogalactan. Also useful are cationic glyoxylated vinylamide wet strength resins as described in U.S. Pat. No. 3,556,932 issued to Coscia et al. on Jan. 19, 1971, and in U.S. Pat. No. 5,466,337, "Repulpable Wet Strength Paper," issued to William B. Darlington and William G. Lanier on Nov. 14, 1995, herein incorporated by reference. Useful water-soluble cation resins include polyacrylamide resins such as those sold under the Parez trademark, such as Parez 631NC, by American Cyanamid Company of Stanford, Conn., generally described in the above-mentioned patent issued to Coscia et al. and in U.S. Pat. No. 3,556,933 issued to Williams et al. on Jan. 19, 1971. U.S. Pat. No. 4,605,702, Guerro et al., issued Aug. 12, 1986, discloses temporary wet strength resin made by reacting a vinylamide polymer with glyoxal, and then subjecting the polymer to an aqueous base treatment. The product is said to provide tissue paper which loses a part of its wet strength when soaked in water at neutral pH. U.S. Pat. No. 4,603,176, Bjorkquist and Schmidt, issued Jul. 29, 1986, discloses related temporary wet strength resins. Generally, the cationic temporary wet strength agent is provided by the manufacturer as an aqueous solution and is added to the pulp in an amount of from about 0.05 to about 0.4 wt % and more typically in an amount of from about 0.1 to about 0.2 wt %. Depending on the nature of the resin, the pH of the pulp is adjusted prior to adding the resin. The manufacturer of the resin will usually recommend a pH range for use with the resin. The Parez 631NC resin, for example, can be used at a pH of from about 4 to about 8.

The fifth step is depositing said papermaking furnish on a foraminous surface to form an embryonic web. This step may further comprise dewatering and other operations known in the art prior to drying of the web. Examples of known dewatering and other operations are given in U.S. Pat. No. 5,656,132, issued Aug. 12, 1997 to Farrington et al., herein incorporated by reference.

The sixth and final step is drying the web. Any of the techniques known to those skilled in the papermaking art for drying wet fibrous webs can be used. Typically, the web is dried by heat supplied by air moving around, over, or through the web; by contact with a heated surface; by infrared radiation; by exposure to superheated steam, or by a combination of such methods. The exact point at which the wet strength agent begins to cure during the drying of the wet fibrous web is an indistinct one. What is required in the present invention is that the fibrous web be substantially dried and that the wet strength bonds of whatever nature as provided by the wet strength resin begin to form. The extent of formation of these bonds must have proceeded to such an extent that subsequent process steps will not appreciably interfere with their ultimate completion and the corresponding wet strength development. In general, though not necessarily in all cases, it is desired that the temperature of said web be sufficiently elevated to effectively cure the wet strength agent (i.e., drying may or may not require high temperature curing). The wet:dry tensile strength ratio of the dried web can be at about 0.1 or greater, preferably about 0.2 or greater, more preferably about 0.3 or greater and more preferably still about 0.4 or greater when the process has been properly executed.

The final wet strength of the paper for a given dose of wet strength agent should be greater than is achieved by the use of the wet strength agent without addition of the reactive anionic compound. The increase can be about 10 percent or greater, more specifically about 20 percent or greater, and more specifically still about 30 percent or greater.

The present invention offers multiple advantages over prior art techniques for enhancing wet strength. The present invention requires no coloration or dying of the fibers, and requires no bleaching or discharging of chromophores to maintain a white sheet. The present invention requires no addition of NaCl or other chlorides to drive the reaction of the reactive anionic compound with the fiber. Further, the present invention does not require highly dilute fiber slurries in the fiber pretreatment step but has been demonstrated successfully at fiber consistencies as high as 30%. Further, the present invention does not rely on ionic bonds to enhance strength, but takes advantage of reactive wet strength agents that form covalent bonds with the cellulose surface, though ionic bonds do provide the initial attachment of the cationic polymer with the sulfonic groups of the reactive anionic compound.

The novel use of fiber reactive anionic compounds in the present invention can also be coupled with chemical debonder agents to make paper with relatively high wet strength and low dry strength. One or more fiber reactive anionic compounds are used with cationic wet strength resins to establish water-resistant covalent bonds, while chemical debonders are used to reduce the number of hydrogen bonds between fibers, thus reducing the dry strength of the paper. This is best done by first increasing anionic sites on the cellulose fibers with said fiber reactive anionic compound, according to steps one through three as previously described, followed by addition of a chemical debonder agent and a cationic wet strength agent. The debonder agent may be applied to the fibers after step three while the fibers are in solution, followed by addition of the cationic wet strength agent as in step four, whereafter the paper is formed, dewatered, and dried according to steps five and six above. In this case, wherein the debonder agent is added to the fibers while they are in slurry form, it is desirable that the cationic wet strength resin be added after the debonder agent has been added to the slurry. Otherwise, the cationic wet strength agent may occupy most anionic sites on the fibers and interfere with retention of the chemical debonder agent. Chemical debonder agents typically have a single cationic site, such as a quaternary ammonium salt, with fatty acid chains.

Alternatively, the debonder agent may be applied to the dried or partially dried paper web during step six through known means such as spraying, printing, coating, and the like. Preferably, the web has been dried enough to begin formation of covalent bonds in the web. The web should then be at a solids level (consistency) of preferably about 40 percent or greater, more preferably about 60 percent or greater, more preferably still about 70 percent or greater, most preferably about 80 percent or greater, and desirably from about 60 to about 90 percent. The debonder maybe applied at other times, but for best results it should be either between steps 3 and 4 or during step 6 of the process described above.

When properly applied, the debonder agent interferes with hydrogen bond formation between the fibers, thus reducing the dry strength of the paper, while having relatively little effect on covalent bond formation. The result is a paper with an increased wet:dry tensile strength ratio. Such paper can have reduced stiffness and improved softness due to the reduced extent of hydrogen bonding, while still having high wet strength.

Desirable chemical debonder agents have less than five cationic sites per molecule and preferably no more than one cationic site which can bond with the anionic sites on the cellulose fiber surface. Large numbers of cationic sites could interfere with the anionic sites provided by the fiber reactive anionic compound if the debonder is applied to the fibers before covalent bonds have formed. Examples of useful chemical debonder agents include fatty chain quaternary ammonium salts (QAS) such as Berocell 584, an ethoxylated QAS made by Eka Nobel, Inc. (Marietta, Ga.), or compounds made by Witco Corp., Melrose Park, Ill., including C-6027, an imidazoline QAS, Adogen 444, a cethyl trimethyl QAS, Varisoft 3690PG, an imidazoline QAS, or Arosurf PA 801, a blended QAS. Agents known as softeners in the art of tissue making are also likely to be suitable as chemical debonder agents. Relative to the dry mass of the fibers, debonder may be added at a level in the range of 0.1% to 2%, preferably 0.2% to 1.5%, and more preferably 0.5% to 1%.

Under the present invention, the increased substantivity of wet strength agents obviously will improved the wet strength of the paper or tissue so produced, but may also offer the potential for other improved physical properties as well. For example, improved fiber-fiber bonding caused by the wet strength resin and the reactive anionic compound itself can improve dry strength and other strength properties (particularly if the reactive anionic compound has a plurality of fiber reactive groups to permit inter-fiber bonds to form). Improved fiber bonding, especially improved wet strength, may be correlated with improved wet resiliency, as defined in Wendt et al., U.S. Pat. No. 5,672,248, issued Sep. 30, 1997, herein incorporated by reference. In tissue production, for example, it is known that improved tensile strength achieved by chemical bonds can be exploited to permit more intense creping of the web leading to improved bulk and potentially to improved softness.

To achieve good softness and opacity, it is desirable that the tissue web comprise substantial amounts of hardwood. For good strength, substantial amounts of softwood are desired. Both strength and softness are often achieved through layered tissues, such as those produced from stratified headboxes wherein at least one layer delivered by the headbox comprises softwood fibers while another layer comprises hardwood or other fiber types. Layered tissue structures produced by any means known in the art are within the scope of the present invention, including those disclosed by Edwards et al. in U.S. Pat. No. 5,494,554, issued Feb. 27, 1996, herein incorporated by reference.

Wet strength agents and reactive anionic compounds may be added to any layer independent from other layers in a tissue or paper web, but in a preferred embodiment they are added to the predominantly softwood component of a tissue web to enhance the physical properties of the strength layer. However, excellent results in physical property improvement have also been observed in predominantly hardwood fiber structures (bleached kraft hardwood, for example), particularly a dramatic increase in TEA (tensile energy absorbed in the dry state during tensile tests), suggesting that layered tissue production with reactive anionic compounds and wet strength agents in predominantly hardwood layers of a tissue could offer improvements in physical properties.

EXAMPLES

Example 1

Figure 2:
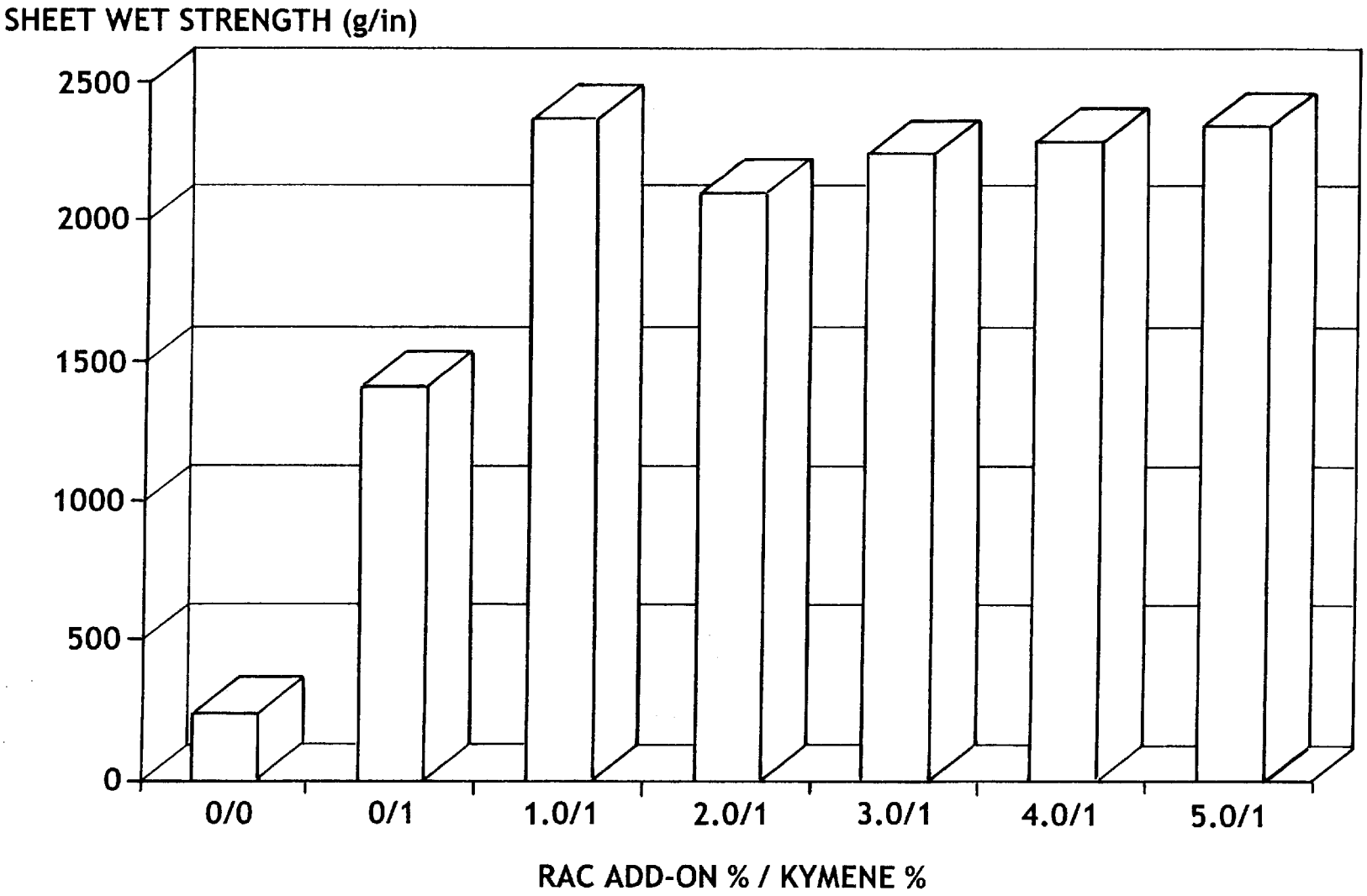
FIGS. 2 through 4 are bar graphs showing the physical properties of 60 gsm handsheets made according to Example 1 at various levels of added fiber reactive anionic compound (RAC) and Kymene.
Figure 3:
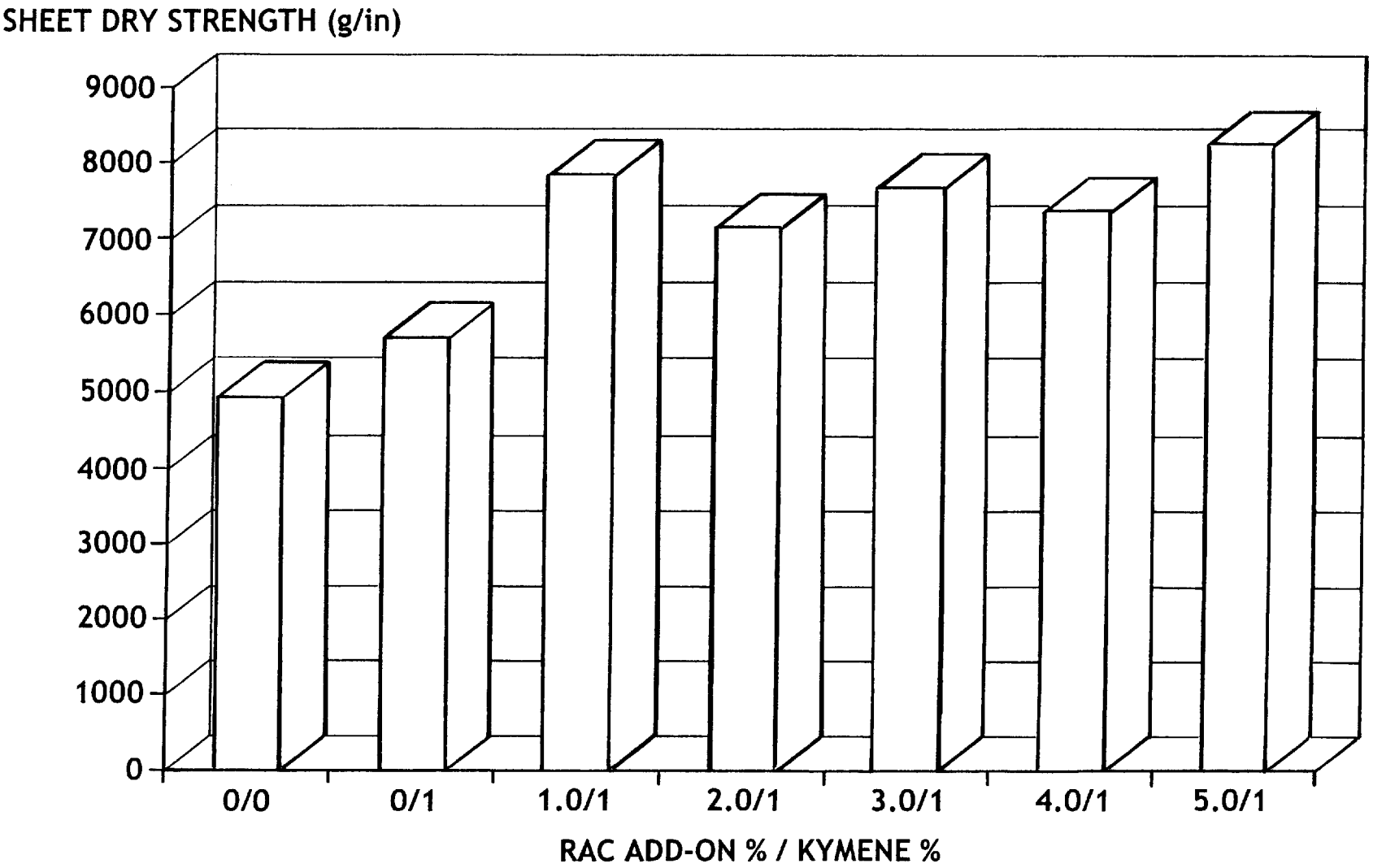
Figure 4:
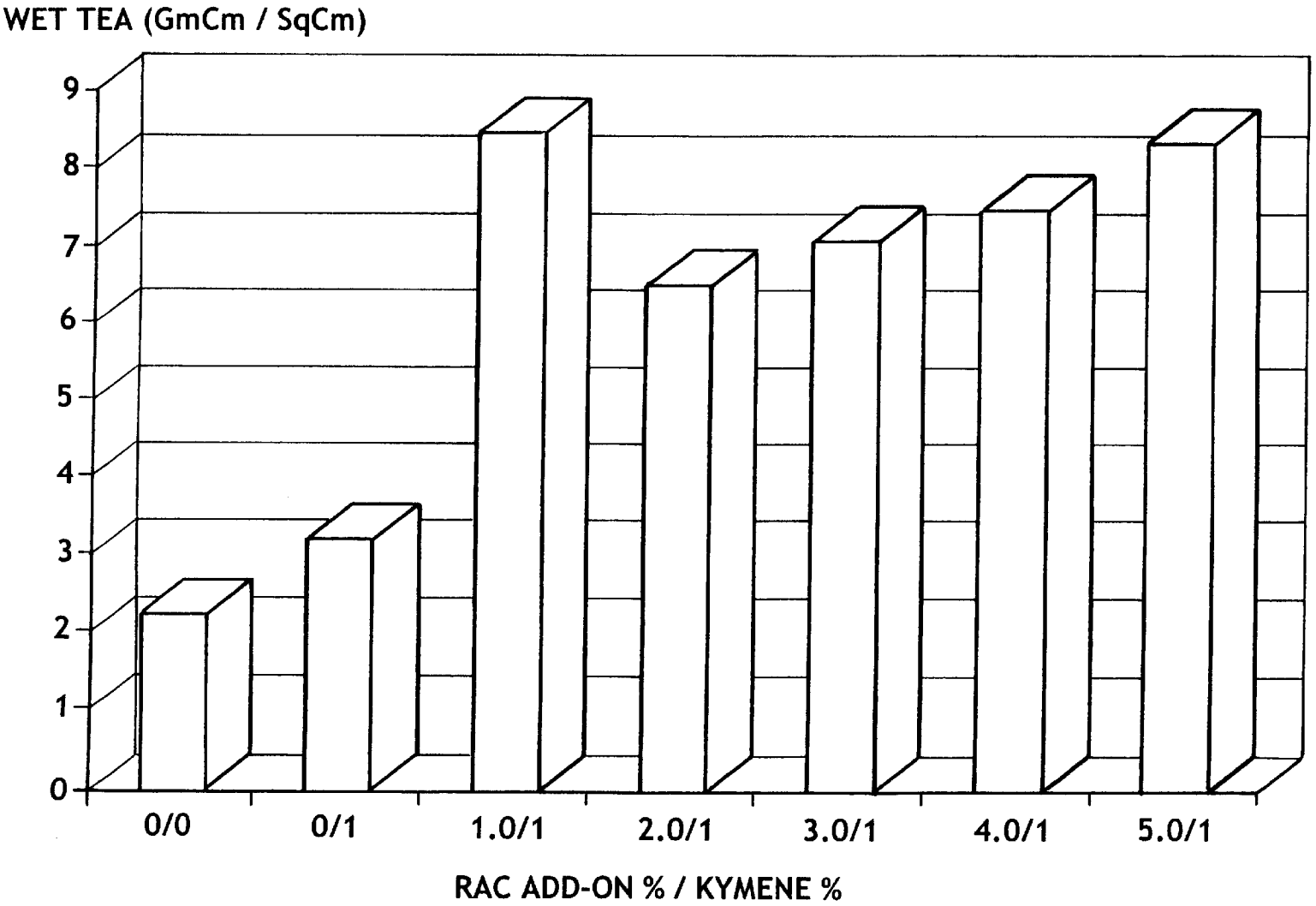
Figure 5:
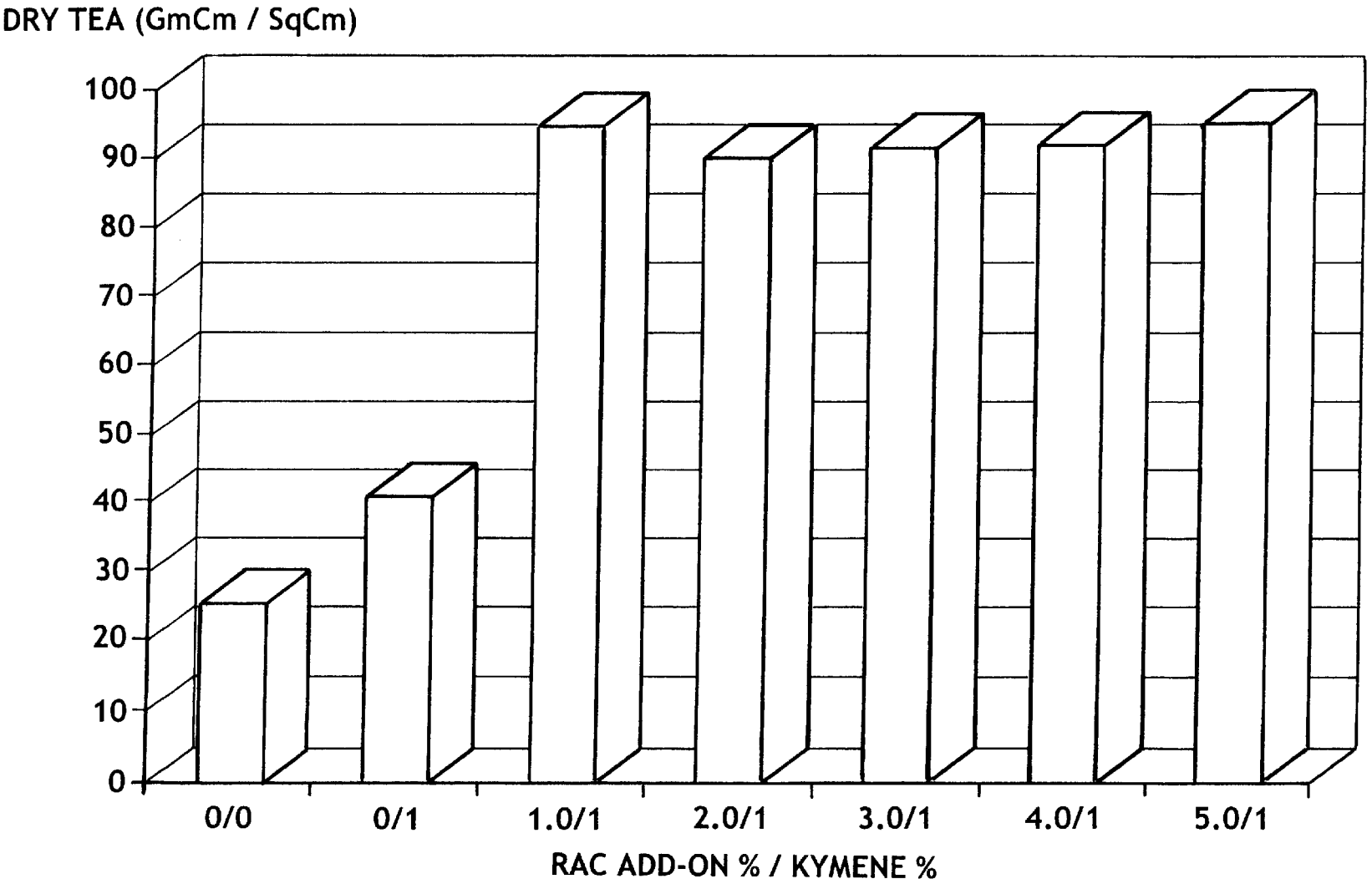
FIG. 5 depicts dry TEA.

100 gm of a dried bleached virgin northern softwood kraft pulp (Kimberly-Clark LL-19 pulp) was saturated with 1200 ml of water and dispersed into a slurry through agitation in a Hobart mixer. The slurry was dewatered to a fiber consistency of about 25%. This was repeated several times to obtain multiple batches of high consistency pulp. For each batch of pulp, between 1 and 4 grams of Sandospace S (Clariant Corp., Charlotte, N.C.) was prepared and diluted with 5 parts of water per part of reagent (thus, the amount of dilution water ranged from 5 to 20 grams of water). Each batch of fiber slurry, comprising 100 gm of fiber per batch, was then reloaded into the Hobart mixer and a Sandospace S solution, containing between 1 and 4 gm of Sandospace S was added during agitation of the pulp. The mixture was thoroughly blended at 25° C. for 25 minutes. Then $NaHCO_3$ was added to each batch at a dose of 0.5 gm of $NaHCO_3$ per gm of Sandospace S (for a range of 0.5 to 2 gm of $NaHCO_3$), with the $NaHCO_3$ having been first dispersed in 5–10 ml of water prior to addition to the mixture of fiber, water, and Sandospace S. Following addition of $NaHCO_3$, the mixture was further blended in the Hobart mixer for 20 min at 25° C. Thereafter, the mixture was heated to 100° C. in an oven and maintained at said temperature for 2 hours without mixing. After cooling the slurry to 25° C., without post-washing of the slurry, the slurry was formed into 60 gsm handsheets using standard Tappi procedures. Kymene 557LX wet strength agent was added to the diluted handsheet slurry at a level of 1% Kymene on a dry fiber basis. The properties of these handsheets are shown in FIGS. 2–5. Sheet wet strength is shown to have increased substantially as the level of Sandospace S was increased, even though the amount of wet strength agent was constant. This demonstrates the ability of the fiber reactive anionic compound to improve the efficiency and substantivity of the Kymene, which is a cationic wet strength agent.

Untreated LL19 fiber handsheets with 1% Kymene had a wet strength of 1411 grams/in and a wet:dry tensile strength ratio of 24.6%. With pretreatment by the Sandospace S fiber reactive anionic compound, the same level of Kymene resulted in a wet strength of 2374 g/in and a wet:dry tensile strength ratio of 30.1% when 1% of the Sandospace S was applied. Results from tensile testing are shown in Table 1. Up to a 68% increase in wet strength was possible with fiber reactive anionic compound relative to the use of 1% Kymene alone. Comparing the TEA values of the "0/1" and "1/1" cases (a web with no RAC and 1% Kymene compared to a web with 1% RAC and 1% Kymene) in Table 1, it is evident that the addition of the reactive anionic compound to fibers with Kymene present dramatically increased TEA (nearly tripled for Wet TEA and more than doubled for Dry TEA) and significantly increased dry strength though not as dramatically as wet strength (thus, the wet:dry tensile ratio increases with the addition of RAC in a system that will later contain wet strength resins). TEA refers to the "tensile energy absorbed" during standard testing of mechanical properties and relates to product performance. A sheet that absorbs more tensile energy before failure in testing is less likely to fail in use and may seem more resilient.

TABLE 1

Results from Example 1 (post-alkalization)

| % RAC/% Kymene (dry fiber basis) | 0/0 | 0/1 | 1/1 | 2/1 | 3/1 | 4/1 | 5/1 |
|---|---|---|---|---|---|---|---|
| wet strength | 236 | 1411 | 2374 | 2100 | 2242 | 2290 | 2348 |
| dry strength | 4952 | 5723 | 7861 | 7147 | 7679 | 7361 | 8258 |

TABLE 1-continued

| % RAC/% Kymene (dry fiber basis) | 0/0 | 0/1 | 1/1 | 2/1 | 3/1 | 4/1 | 5/1 |
|---|---|---|---|---|---|---|---|
| Results from Example 1 (post-alkalization) | | | | | | | |
| Wet TEA | 2.24 | 3.21 | 8.49 | 6.52 | 7.11 | 7.51 | 8.39 |
| Dry TEA | 25.45 | 41.05 | 95 | 90.42 | 92 | 92.43 | 95.68 |

Example 2

All steps were conducted as in Example 1 except that the $NaHCO_3$ solution was added prior to the addition of the Sandospace S solution, resulting in pre-alkalization rather than post alkalkization. Up to a 46% increase in wet strength with fiber reactive anionic compound was possible relative to paper made with the Kymene alone. Note that at 1 % RAC (reactive anionic compound), a wet strength of 1606 g was achieved with pre-alkalization compared to 2374 g with post-alkalization.

TABLE 2

| % RAC/% Kymene (dry fiber basis) | 0/0 | 0/1 | 1/1 | 2/1 | 3/1 | 4/1 | 5/1 |
|---|---|---|---|---|---|---|---|
| Results from Example 2 (pre-alkalization) | | | | | | | |
| wet strength | 236 | 1594 | 1606 | 1872 | 2115 | 2334 | 2330 |
| dry strength | 4953 | 5889 | 6934 | 7651 | 7609 | 7621 | 7632 |
| Wet TEA | 2.24 | 6.28 | 9.03 | 11.29 | 12.8 | 14.13 | 14.4 |
| Dry TEA | 25.45 | 33.25 | 64.72 | 79.64 | 75.1 | 74.2 | 75 |

Example 3

45 kg of a bleached northern softwood kraft pulp was pulped at 25° C. for 20 minutes in a high consistency pulper at a consistency of 8%. 3.6 kg (8% relative to the fiber mass) of Sandospace S paste, as received from Clariant Corp., was added to the slurry in the pulper and mixed for an additional 20 minutes. 0.9 kg of sodium carbonate powder was added to the slurry in the pulper and mixed for another 20 minutes. The slurry was then heated to 60° C. and maintained at that temperature for 2 hours and then dewatered with a centrifuge to 35% consistency. The fibers were then ready for use in papermaking without any washing.

The 35% consistency fibers were then diluted with water to make handsheets according to Tappi procedures for handsheet making. Then Berocell 584 liquid (Eka Nobel Corp., Marietta, Ga.) was added to the dilute slurry at a dose of 1 gram of Berocell liquid per 100 grams of fiber (1% Berocell on a dry fiber basis) and stirred for 20 minutes. Thereafter, 1% Kymene 557LX on a dry fiber basis was also added to the slurry and stirred for 20 minutes. Then 60 gsm handsheets were formed according to Tappi procedures and tested for dry and wet tensile strength properties.

The 60 gsm handsheets had a mean wet strength of 2160 g/inch and a mean dry strength of 4929 g/inch. The wet:dry tensile strength ratio for the handsheets of this example was 43.8%, in contrast to typical values of 30–35% for sheets with Kymene but without debonder, as in Example 1. A handsheet made according to this Example but without any added debonder had a wet:dry tensile strength ratio of 35.1%.

Example 4

Handsheets were prepared as described in Example 3, except that no debonder was added to the fibrous slurry. A 1% by weight aqueous solution of Berocell liquid was prepared and sprayed onto the dried handsheets using a common household hand sprayer. Spray was applied evenly to both sides of the handsheets until the added liquid mass was approximately 100% of the dry handsheet mass, resulting in a total application of 1% pure Berocell to the fibers on a dry fiber basis (1 gram of added Berocell per 100 grams of fiber). Then the handsheets were dried at 105° C. for 20 minutes and then cooled, conditioned, and tested for tensile strength. The mean wet strength was 2897 g/inch and the dry strength was 6551 g/inch, yielding a wet:dry tensile ratio of 44.3%.

It will be appreciated that the foregoing examples, given for purposes of illustration, are not to be construed as limiting the scope of this invention, which is defined by the following claims and all equivalents thereto.

We claim:

1. A method for making wet strength paper comprising the steps of:

a) providing an aqueous slurry of cellulosic papermaking fibers;

b) adding a substantially colorless reactive anionic compound to said aqueous slurry, said reactive anionic compound having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is NH or

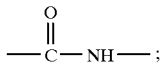

X is a moiety suitable for forming a covalent bond to a hydroxyl group on cellulose, selected from the group consisting of monohalotriazine, dihalotriazine, trihalopyrimidine, dihalopyridazinone, dihaloquinoxaline, dihalophtalazine, halobenzothiazole, acrylamide, vinylsulfone, β-sulfatoethylsylfonamide, β-chloroethylsulfone, and methylol;

B is hydrogen, a group of the formula Y—R (wherein Y and R are defined as above), or a group of the formula Y—R—W (wherein Y, R, and W are defined as above);

c) adjusting the pH and temperature of said aqueous slurry to promote reaction of the reactive anionic compound with the cellulosic fibers;

d) adding a cationic wet strength agent and water to said aqueous slurry to create a papermaking furnish;

e) depositing said papermaking furnish on a foraminous surface to form an embryonic web; and f) drying the web.

2. The method of claim 1, wherein the amount of the reactive anionic compound is from about 0.01 to about 4 dry weight percent of the dry fiber mass of the web.

3. The method of claim 1, wherein the amount of the cationic wet strength agent is from about 0.02 to about 1.5 dry weight percent of the dry fiber mass of said web.

4. The method of claim 1, wherein the consistency of fiber in said aqueous slurry is about 5% or greater during the step of adding the reactive anionic compound.

5. The method of claim 1, wherein the consistency of fiber in said aqueous slurry is about 20% or greater during the step of adding the reactive anionic compound.

6. The method of claim 1, wherein group X of the reactive anionic compound is a moiety selected from the group consisting of dichlorotriazine, trichloropyrimidine, and dichloropyridazinone.

7. The method of claim 1, wherein the amount of sodium chloride present in the aqueous slurry of step (c) is less than 0.01 g per gram of fiber.

8. The method of claim 1, wherein the step of adjusting the pH of said slurry is achieved through the addition of an alkaline agent selected from the group consisting of $NaHCO_3$, $Na_2CO_3$, $Na_3PO_4$ and NaOH.

9. The method of claim 1, wherein the cationic wet strength agent is a crosslinkable agent.

10. The method of claim 1, wherein the cationic wet strength agent is a permanent wet strength agent.

11. The method of claim 1, wherein the cationic wet strength agent is a temporary wet strength agent.

12. The method of claim 1, wherein the wet strength of the dried web is about 2000 grams per inch or greater based on a 60 gsm Tappi handsheet.

13. The method of claim 1, wherein the wet strength of the dried web is at least 20 percent greater than the wet strength of an otherwise identical web made without the addition of the reactive anionic compound.

14. The method of claim 1, wherein the wet:dry strength ratio of the dried web is about 0.2 or greater.

15. The method of claim 1, wherein the wet:dry strength ratio of the dried web is about 0.4 or greater.

16. The method of claim 1, wherein the pH in step (c) is adjusted to be in the range of from about 8 to about 11.

17. The dried web made according to the method of any one of claims 1–12 having a wet:dry strength ratio of about 0.2 or greater.

18. The method of claim 1, further comprising the steps of adding a chemical debonder agent to said aqueous slurry prior to the step of adding a cationic wet strength agent.

19. The method of claim 1, further comprising the step of adding a chemical debonder agent to said aqueous slurry after the step of adding a cationic wet strength agent.

20. The method of claim 19, wherein said chemical debonder agent is applied to said web during the step of drying the web, such that the web is at least partially dried prior to application of said chemical debonder agent.

21. The dried web made by the method of claim 18 or 19 having a wet:dry strength ratio of 0.3 or greater.

22. A method for making wet strength paper comprising the steps of:

a) providing an aqueous slurry of cellulosic papermaking fibers;

b) adding a substantially colorless reactive anionic compound to said aqueous slurry, said reactive anionic compound having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is a linking group selected from NH, $SO_2$, CO and CONH;

X is a fiber reactive group capable of forming a covalent bond to a hydroxyl group on cellulose;

B is hydrogen, a group of the formula Y—R (wherein Y and R are defined as above), or a group of the formula Y—R—W (wherein Y, R, and W are defined as above);

c) adjusting the pH and temperature of said aqueous slurry to promote reaction of the reactive anionic compound with the cellulosic fibers;

d) adding a cationic wet strength agent and water to said aqueous slurry to create a papermaking furnish;

e) depositing said papermaking furnish on a foraminous surface to form an embryonic web; and f) drying the web.

23. The method of claim 22, wherein X in said reactive anionic compound is selected from the group consisting of monohalotriazine, dihalotriazine, monohalopyrimidine, dihalopyrimidine, trihalopyrimidine, dihalopyridazinone, dihaloquinoxaline, dihalophtalazine, halobenzothiazole, α-haloacrylamide; vinylsulfone, β-sulfatoethylsylfonamide, β-chloroethylsulfone, and methylol.

24. The method of claim 22, wherein X in said reactive anionic compound is a halo-substituted six-membered heterocyclic radical with two or three ring nitrogen atoms and Y is —NH—.

25. The method of claim 22, wherein R in said reactive anionic compound comprises a six-membered heterocyclic radical with two or three ring nitrogen atoms.

26. The method of claim 22, wherein said reactive anionic compound is substantially colorless in UV and visible light.

27. The method of claim 22, wherein said reactive anionic compound comprises a plurality of fiber reactive groups.

28. The method of claim 22, wherein said reactive anionic compound is not a fluorescent whitening agent.

29. The method of claim 22, wherein said reactive anionic compound is a fluorescent whitening agent.

30. The method of claim 22, wherein said reactive anionic compound is not a stilbene derivative.

31. The method of claim 22, wherein said reactive anionic compound is a stilbene derivative.

32. The method of claim 22, further comprising the step of mechanical softening of said web.

33. The method of claim 22, further comprising the step of creping said web.

34. The method of claim 22, wherein said papermaking fibers comprise about 50 percent or more hardwood fibers by weight.

35. The method of claim 22, wherein said papermaking fibers comprise about 80 percent or more softwood fibers by weight.

36. A tissue web produced according to claim 22.

37. The method of claim 22, wherein said aqueous slurry during step (c) has a fiber consistency of at about 3 percent or greater.

38. The method of claim 22, wherein said aqueous slurry during step (c) has a fiber consistency of about 5 percent or greater.

39. The method of claim 22, wherein said aqueous slurry during step (c) has a fiber consistency of about 8 percent or greater.

40. The method of claim 22, wherein said aqueous slurry has a fiber consistency of from about 10 to about 30 percent.

41. The method of claim 22, wherein said papermaking fibers comprise about 10 percent or greater high-yield fibers.

42. The method of claim 22, wherein said papermaking fibers comprise about 20 percent or greater high-yield fibers.

43. The method of claim 22, wherein said papermaking fibers comprise about 10 percent or greater BCTMP fibers.

44. The method of claim 22, wherein the amount of the reactive anionic compound is from about 0.01 to about 4 dry weight percent of the dry fiber mass of the web.

45. The method of claim 22, wherein the amount of the cationic wet strength agent is from about 0.02 to about 1.5 dry weight percent of the dry fiber mass of said web.

46. The method of claim 22, wherein the consistency of fiber in said aqueous slurry is about 5 percent or greater during the step of adding the reactive anionic compound.

47. The method of claim 22, wherein the fiber consistency in said aqueous slurry is about 20 percent or greater during the step of adding the reactive anionic compound.

48. The method of claim 22, wherein group X of the reactive anionic compound is a moiety selected from the group consisting of dichlorotriazine, trichloropyrimidine, and dichloropyridazinone.

49. The method of claim 22, wherein the amount of sodium chloride present in the aqueous slurry of step (c) is about 0.01 gram per gram of fiber or less.

50. The method of claim 22, wherein the step of adjusting the pH of said slurry is achieved through the addition of an alkaline agent selected from the group consisting of $NaHCO_3$, $Na_2CO_3$, $Na_3PO_4$ and NaOH.

51. The method of claim 22, wherein the cationic wet strength agent is a crosslinkable agent.

52. The method of claim 22, wherein the cationic wet strength agent is a permanent wet strength agent.

53. The method of claim 22, wherein the cationic wet strength agent is a temporary wet strength agent.

54. The method of claim 22, wherein the wet strength of the dried web is about 2000 grams per inch or greater based on a 60 gsm Tappi handsheet.

55. The method of claim 22, wherein the wet strength of the dried web is at least 10 percent greater than the wet strength of an otherwise identical web made without the addition of the reactive anionic compound.

56. The method of claim 22, wherein the wet:dry strength ratio of the dried web is about 0.2 or greater.

57. The method of claim 22, wherein the wet:dry strength ratio of the dried web is about 0.3 or greater.

58. The method of claim 22, wherein the pH in step (c) is adjusted to be in the range of from about 8 to about 11.

59. The method of claim 22, further comprising the steps of adding a chemical debonder agent to said aqueous slurry prior to the step of adding a cationic wet strength agent.

60. The method of claim 22, further comprising the step of adding a chemical debonder agent to said aqueous slurry after the step of adding a cationic wet strength agent.

61. The method of claim 22, wherein said method does not comprise a salting step.

62. The method of claim 22, wherein said method does not comprise a washing step after adding the reactive anionic compound and prior to depositing the furnish on a foraminous surface.

63. The method of claim 60, wherein said chemical debonder agent is applied to said web during the step of drying the web, such that the web is at least partially dried prior to application of said chemical debonder agent.

64. The dried web made by the method of claim 59 or 60 having a wet:dry strength ratio of about 0.3 or greater.

65. A wet-strength paper web comprising:

a) cellulosic papermaking fibers;

b) from about 0.02 to about 1.5 dry weight percent, based on dry fiber, of a cationic wet strength additive; and c) from about 0.01 to about 4 dry weight percent, based on dry fiber, of a reactive anionic compound, said reactive anionic compound being substantially colorless in both visible and UV light and having the formula:

W—R—Y—X—B wherein:

W is sulfonyl or carboxyl or salts thereof;

R is an aliphatic, an aromatic, an inertly or essentially inertly substituted aromatic, a cyclic, a heterocyclic, or an inertly or essentially inertly substituted heterocyclic radical;

Y is —H— or —ONH—;

X is a fiber-reactive group suitable for forming a covalent bond to a hydroxyl group on cellulose; and B is hydrogen, a group of the formula Y—R (wherein Y and R are defined as above), or a group of the formula Y—R—W (wherein Y, R, and W are defined as above).

66. The paper web of claim 65, further comprising from about 0.1 to about 2.0 percent of a chemical debonder agent.

67. The paper web of claim 65, wherein the web is substantially free of fluorescent whitening agents.

68. The paper web of claim 65, wherein said reactive anionic compound is not a stilbene derivative.

69. The paper web of claim 65, wherein said web is a layered tissue.

70. The paper web of claim 65, wherein said web is a creped tissue.

71. The paper web of claim 65, wherein said web is a through-dried tissue.

72. The paper web of claim 65, wherein said web is an uncreped, through-dried tissue.

73. A paper towel comprising the paper web of claim 65.

74. An absorbent article comprising the paper web of claim 65.

75. The paper web of claim 65 comprising at least 50 percent hardwood fibers by weight.

76. The paper web of claim 65, wherein the reactive anionic compound is a flourescent whitening agent.

* * * * *

UNITED STATES PATENT AND TRADEMARK OFFICE

CERTIFICATE OF CORRECTION

PATENT NO. : 5,935,383
DATED : August 10, 1999
INVENTOR(S) : T. Sun et al.

It is certified that error appears in the above-identified patent and that said Letters Patent is hereby corrected as shown below:

Column 9,
Line 50, begin a new paragraph with "Water".

Column 30,
Line 38, delete "–H–" and insert -- –NH– -- therefor; and
delete "–ONH–" and insert -- "–CONH– -- therefor.

Signed and Sealed this

Twenty-sixth Day of February, 2002

*Attest:*

*Attesting Officer*

JAMES E. ROGAN
*Director of the United States Patent and Trademark Office*